US010965012B2

(12) United States Patent
Hyjazie et al.

(10) Patent No.: US 10,965,012 B2
(45) Date of Patent: Mar. 30, 2021

(54) MULTI-FILAR HELICAL ANTENNA

(71) Applicant: Huawei Technologies Co., Ltd, Shenzhen (CN)

(72) Inventors: Fayez Hyjazie, Ottawa (CA); Wen Tong, Ottawa (CA); Paul Robert Watson, Kanata (CA)

(73) Assignee: HUAWEI TECHNOLOGIES CO., LTD., Shenzhen (CN)

( * ) Notice: Subject to any disclaimer, the term of this patent is extended or adjusted under 35 U.S.C. 154(b) by 0 days.

(21) Appl. No.: 14/839,192

(22) Filed: Aug. 28, 2015

(65) Prior Publication Data

US 2017/0062917 A1 Mar. 2, 2017

(51) Int. Cl.

| | |
|---|---|
| ***H01Q 9/04*** | (2006.01) |
| ***H01Q 1/36*** | (2006.01) |
| ***H01Q 11/08*** | (2006.01) |
| ***H01Q 5/50*** | (2015.01) |

(52) U.S. Cl.
CPC ..... *H01Q 1/362* (2013.01); *H01Q 5/50* (2015.01); *H01Q 11/08* (2013.01)

(58) Field of Classification Search
None
See application file for complete search history.

(56) References Cited

U.S. PATENT DOCUMENTS 3,573,840 A * 4/1971 Gouillou ..... H01Q 1/38 343/895
5,587,719 A * 12/1996 Steffy ..... B64G 1/22 343/853

(Continued)

FOREIGN PATENT DOCUMENTS

CN 1241307 A 1/2000
CN 1348619 A 5/2002

(Continued)

OTHER PUBLICATIONS

SIPO of the P.R. China: International Search Report and Written Opinion issued in corresponding Intemation Application No. PCT/CN2018/076351.

(Continued)

*Primary Examiner* — Trinh V Dinh
(74) *Attorney, Agent, or Firm* — BCF LLP

(57) ABSTRACT

A multi-filar helical antenna comprising a helical radiating element extending along a longitudinal axis, comprising an elongate body having a free first end and a second end opposite the first end and coupled to a feeding port, and a tail member, extending away from the body at the second end. The tail member has a geometry that is selected for modifying at least one of an impedance of the radiating element, and broadening the antenna's resonance bandwidth. The radiating element may comprise a positioning member extending away from the second end along a direction substantially parallel to the axis. An end portion of the positioning member is secured to an electrically conductive surface in connection with the feeding port. The second end is positioned at a given distance above the conductive surface and the radiating element is fed through the feeding port at the given distance above the conductive surface.

17 Claims, 17 Drawing Sheets

(56) References Cited

U.S. PATENT DOCUMENTS

| | | | | |
|---|---|---|---|---|
| 5,635,945 | A * | 6/1997 | McConnell | H01Q 1/362 343/860 |
| 5,909,196 | A | 6/1999 | O'Neill, Jr. | |
| 6,011,525 | A * | 1/2000 | Piole | H01Q 1/24 343/745 |
| 6,184,844 | B1 * | 2/2001 | Filipovic | H01Q 1/362 343/853 |
| 6,373,448 | B1 | 4/2002 | Chun | |
| 6,384,798 | B1 * | 5/2002 | Barta | H01Q 11/08 343/895 |
| 6,535,179 | B1 * | 3/2003 | Petros | H01Q 1/362 343/895 |
| 6,559,811 | B1 * | 5/2003 | Pulimi | H01Q 1/242 343/702 |
| 6,621,458 | B1 * | 9/2003 | Petros | H01Q 1/38 343/700 MS |
| 7,068,227 | B2 * | 6/2006 | Ying | H01Q 1/242 343/702 |
| 10,693,242 | B2 * | 6/2020 | Hyjazie | H01Q 21/28 |
| 2002/0118075 | A1 | 8/2002 | Ohwada et al. | |
| 2003/0020669 | A1 * | 1/2003 | Yasukawa | H01Q 1/362 343/895 |
| 2005/0184924 | A1 * | 8/2005 | Fossett | H01Q 1/242 343/895 |
| 2005/0219144 | A1 * | 10/2005 | Ying | H01Q 1/242 343/895 |
| 2005/0264468 | A1 * | 12/2005 | Yegin | H01Q 11/08 343/895 |
| 2006/0022891 | A1 * | 2/2006 | O'Neill | H01Q 11/08 343/895 |
| 2006/0170611 | A1 * | 8/2006 | Ko | H01Q 5/371 343/895 |
| 2010/0013736 | A1 * | 1/2010 | Ogawa | H01Q 1/38 343/895 |
| 2010/0177014 | A1 | 7/2010 | Min et al. | |
| 2011/0215984 | A1 | 9/2011 | Coburn et al. | |
| 2011/0221648 | A1 * | 9/2011 | Lee | H01Q 9/285 343/826 |
| 2011/0248894 | A1 * | 10/2011 | Crowley | H01Q 1/08 343/702 |
| 2012/0242555 | A1 * | 9/2012 | Hsieh | H01Q 1/243 343/833 |
| 2013/0113676 | A1 * | 5/2013 | Liu | H01Q 1/362 343/850 |
| 2018/0198194 | A1 * | 7/2018 | Hyjazie | H01Q 11/08 |

FOREIGN PATENT DOCUMENTS

| | | | |
|---|---|---|---|
| CN | 101682120 | A | 3/2010 |
| CN | 103117450 | A | 5/2013 |
| EP | 1018187 | A2 | 7/2000 |
| TW | 200402950 | A | 2/2004 |
| WO | 9917395 | A2 | 4/1999 |
| WO | 03094373 | A1 | 11/2003 |

OTHER PUBLICATIONS

John D. Kraus et al. A 50-Ohm Input Impedance for Helical Beam Antennas, IEEE Transactions on Antennas and Propagation, vol. AP-25, No. 6, Nov. 1977. pp. 913.

Chew et al., "Quadrifilar Helix Antenna for Mimo System," IEEE Antennas and Wireless Propagation Letters, vol. 3, No. 1, 2004, pp. 197-199.

Sharaiha et al., Quadrifilar Helical Antennas: Wideband and Multiband Behavior for GPS Applications, IEEE 2010 International Conference on Electromagnetics in Advanced Applications (ICEAA), pp. 620-623.

Brown et al., "The Intelligent Quadrifilar Helix: A Compact MIMO Antenna for IEEE 802.11n," , IET, The Second European Conference on Antennas and Propagation, 2007, pp. 1-4.

* cited by examiner

MULTI-FILAR HELICAL ANTENNA

FIELD

Embodiments described herein generally relate to the field of helical antennas, and more particularly, to multi-filar helical antennas.

BACKGROUND

Multi-filar helical antennas are often used to achieve antenna diversity and have been applied for applications, such as Land Mobile Satellite (LMS) communication and other satellite communications and navigation systems. Advantages of multi-filar helical antennas include increased capacity, low correlation between antenna elements, as well as reduced size and space compared to traditional antennas, such as monopoles. Multi-filar helical antennas are typically tuned using a feed network located on a horizontal printed board provided below the helix of antenna elements. This typically requires additional space and increases the cost and complexity of the overall antenna design.

Therefore, there is a need for an improved multi-filar helical antenna.

SUMMARY

In accordance with one aspect, a multi-filar helical antenna is provided comprising a helical radiating element extending along a longitudinal axis. The radiating element comprises an elongate body having a free first end and a second end opposite the first end, the second end configured to be coupled to a feeding port, and a tail member extending away from the body at the second end. The tail member has a geometry that is selected for at least one of modifying an impedance of the radiating element, and broadening a resonance bandwidth of the antenna.

In some example embodiments, the tail member may extend along a helical path of the body.

In some example embodiments, the tail member may extend along a direction substantially perpendicular to the longitudinal axis.

In some example embodiments, the tail member may comprise a first arm and at least one second arm spaced from the first arm.

In some example embodiments, the first arm may be substantially parallel to the at least one second arm.

In some example embodiments, at least one of the first arm and the at least one second arm may comprise a first section and a second section, the first section angled relative to the second section.

In some example embodiments, the first arm may comprise a first section and a second section, the first section substantially parallel to the at least one second arm and the second section substantially perpendicular to the at least one second arm.

In some example embodiments, the geometry of the tail member may be selected by adjusting at least one of a size of the tail member, a length of the tail member, a width of the tail member, a height of the tail member, a curvature of the tail member, an angle of the tail member relative to the longitudinal axis, a distance between the tail member and an electrically conductive surface the feeding port is provided in, a number of arms of the tail member, a spacing between arms of the tail member, an angle of each arm of the tail member, a thickness of each arm of the tail member, a width of each arm of the tail member, and a height of each arm of the tail member.

In some example embodiments, the radiating element may further comprise a positioning member extending away from the second end along a direction substantially parallel to the longitudinal axis, an end portion of the positioning member configured to be secured to an electrically conductive surface in connection with the feeding port provided in the conductive surface, the second end positioned at a given distance above the conductive surface and the radiating element fed, via the feeding port, at the given distance above the conductive surface.

In some example embodiments, the antenna may further comprise a feed comprising a printed circuit board member configured to be secured to an electrically conductive surface in connection with the feeding port provided in the conductive surface, the printed circuit board member provided on an outer surface thereof with an electrical transmission line extending away from the printed circuit board member along a direction substantially parallel to the longitudinal axis, the transmission line configured to contact the second end at a given distance above the conductive surface for feeding the radiating element at the given distance above the conductive surface.

In some example embodiments, the antenna may comprise a first plurality of the radiating element.

In some example embodiments, the antenna may further comprise a second plurality of the radiating element, each radiating element of the first plurality spaced apart from one another by a first angular distance and each radiating element of the second plurality spaced apart from one another by a second angular distance equal to the first angular distance.

In some example embodiments, the radiating element may be wrapped around the longitudinal axis in one of a right-handed direction and a left-handed direction.

In some example embodiments, the first plurality of the radiating element may be positioned at a first radial distance from the longitudinal axis and the second plurality of the radiating element may be positioned at a second radial distance from the longitudinal axis, the second radial distance smaller than the first radial distance.

In some example embodiments, the first plurality of the radiating element may be positioned at a first radial distance from the longitudinal axis and the second plurality of the radiating element may be positioned at a second radial distance from the longitudinal axis, the second radial distance equal to the first radial distance and the first and second plurality of the radiating element alternately wrapped around the longitudinal axis.

In some example embodiments, the radiating element may conform to a shape selected from the group consisting of a polyhedron, a cylindrical shape, a spherical shape, and a conical shape.

In some example embodiments, the radiating element may be printed on a flexible printed circuit board substrate.

In some example embodiments, the tail member may form an integral part of the body.

In accordance with another aspect, a multi-filar helical antenna is provided comprising a helical radiating element extending along a longitudinal axis. The radiating element comprises an elongate body having a free first end and a second end opposite the first end, and a positioning member extending away from the second end along a direction substantially parallel to the longitudinal axis. An end portion of the positioning member is configured to be secured to an electrically conductive surface in connection with a feeding port provided in the conductive surface with the second end positioned at a given distance above the conductive surface.

In some example embodiments, at least one of a height and a width of the positioning member may be adjusted for tuning a resonance bandwidth of the antenna.

In some example embodiments, the radiating element may further comprise a tail member, extending away from the body at the second end, having a geometry selected for at least one of modifying an impedance of the radiating element, and broadening a resonance bandwidth of the antenna.

In some example embodiments, the positioning member may comprise a feed comprising a printed circuit board member configured to be secured to the conductive surface in connection with the feeding port, the printed circuit board member provided on an outer surface thereof with an electrical transmission line extending away from the printed circuit board member along a direction substantially parallel to the longitudinal axis, the transmission line configured to contact the second end at the given distance above the conductive surface for feeding the one of the radiating element at the given distance above the conductive surface.

In some example embodiments, the antenna may comprise a first plurality of the radiating element.

In some example embodiments, the antenna may further comprise a second plurality of the radiating element, each radiating element of the first plurality spaced apart from one another by a first angular distance and each radiating element of the second plurality spaced apart from one another by a second angular distance equal to the first angular distance.

In some example embodiments, the radiating element may be wrapped around the longitudinal axis in one of a right-handed direction and a left-handed direction.

In some example embodiments, the first plurality of the radiating element may be positioned at a first radial distance from the longitudinal axis and the second plurality of the radiating element may be positioned at a second radial distance from the longitudinal axis, the second radial distance smaller than the first radial distance.

In some example embodiments, the first plurality of the radiating element may be positioned at a first radial distance from the longitudinal axis, and the second plurality of the radiating element may be positioned at a second radial distance from the longitudinal axis, the second radial distance equal to the first radial distance and the first and second plurality of the radiating element alternately wrapped around the longitudinal axis.

In some example embodiments, the radiating element may conform to a shape selected from the group consisting of a polyhedron, a cylindrical shape, a spherical shape, and a conical shape.

In some example embodiments, the radiating element may be printed on a flexible printed circuit board substrate.

In some example embodiments, the positioning member may form an integral part of the body.

Many further features and combinations thereof concerning the present improvements will appear to those skilled in the art following a reading of the instant disclosure.

DESCRIPTION OF THE FIGURES

In the figures.

It will be noted that throughout the appended drawings, like features are identified by like reference numerals.

DETAILED DESCRIPTION

Figure 1:
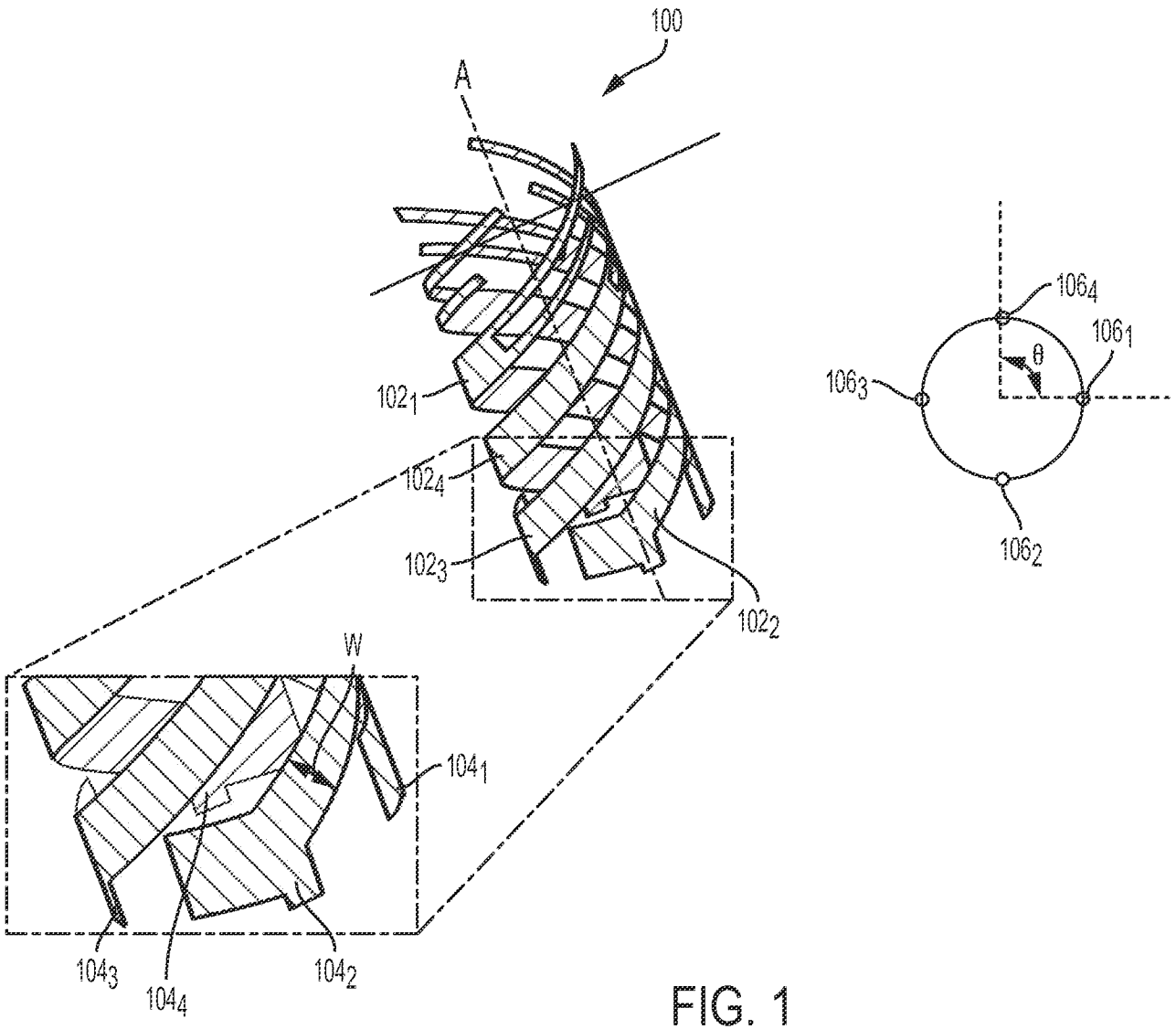
FIG. 1 is a schematic diagram of a four-port multi-filar helical antenna, in accordance with one embodiment.

Referring to FIG. 1, a multi-filar helical antenna 100 in accordance with an illustrative embodiment will now be described. The antenna 100 comprises a plurality of identical elongate helical antenna elements. Although, the antenna 100 of FIG. 1 is illustrated as comprising four (4) antenna elements $\mathbf{102}_1$, $\mathbf{102}_2$, $\mathbf{102}_3$, $\mathbf{102}_4$, it should be understood that the antenna 100 may comprise any other number of antenna elements. In one embodiment, the number (N) of antenna elements is greater than or equal to three (3). In some embodiments, the number (N) of antenna elements is a power of two (2).

Each antenna element $\mathbf{102}_1$, $\mathbf{102}_2$, $\mathbf{102}_3$, or $\mathbf{102}_4$ is wrapped around a support surface (e.g. a hollow dielectric body, not shown) having a longitudinal axis A and has two opposite ends, an open-circuited end and the other end $\mathbf{104}_1$, $\mathbf{104}_2$, $\mathbf{104}_3$, or $\mathbf{104}_4$ being connected to a port $\mathbf{106}_1$, $\mathbf{106}_2$, $\mathbf{106}_3$, or $\mathbf{106}_4$ (e.g. via a probe or connector pin, not shown) through which each antenna element $\mathbf{102}_1$, $\mathbf{102}_2$, $\mathbf{102}_3$, or $\mathbf{102}_4$ is independently fed. This results in a multi-port radiating antenna 100 having a number of independent feeding ports, as in $\mathbf{106}_1$, $\mathbf{106}_2$, $\mathbf{106}_3$, $\mathbf{106}_4$, equal to the number of antenna elements, as in $\mathbf{102}_1$, $\mathbf{102}_2$, $\mathbf{102}_3$, $\mathbf{102}_4$, the antenna elements $\mathbf{102}_1$, $\mathbf{102}_2$, $\mathbf{102}_3$, $\mathbf{102}_4$ being co-located at the base of the antenna 100 and functioning as one element. The number of antenna ports as in $\mathbf{106}_1$, $\mathbf{106}_2$, $\mathbf{106}_3$, $\mathbf{106}_4$ can therefore be varied by varying the number of antenna elements as in $\mathbf{102}_1$, $\mathbf{102}_2$, $\mathbf{102}_3$, $\mathbf{102}_4$. It should be understood that, although antenna elements are described herein as being supported on a support surface, the antenna elements may also be self-supporting.

In one embodiment, the antenna elements $\mathbf{102}_1$, $\mathbf{102}_2$, $\mathbf{102}_3$, $\mathbf{102}_4$ are all wound around the support surface at a same pitch (i.e. the height of each complete turn). It should be understood that, in other embodiments, the antenna elements $\mathbf{102}_1$, $\mathbf{102}_2$, $\mathbf{102}_3$, $\mathbf{102}_4$ may be wound around the support surface at different pitches. The antenna elements $\mathbf{102}_1$, $\mathbf{102}_2$, $\mathbf{102}_3$, $\mathbf{102}_4$ are also wound in a same direction, i.e. a left-handed direction (to achieve a left circular polarization) or a right-handed direction (to achieve a right circular polarization). In one embodiment, the length of each antenna element $\mathbf{102}_1$, $\mathbf{102}_2$, $\mathbf{102}_3$, or $\mathbf{102}_4$ is less than one wavelength at the intended transmission frequency (e.g. substantially equal to a multiple of a quarter-wavelength or less), where the wavelength is inversely proportional to the antenna's operating frequency, and the antenna elements $\mathbf{102}_1$, $\mathbf{102}_2$, $\mathbf{102}_3$, $\mathbf{102}_4$ have a constant width W throughout the length thereof. Still, it should be understood that, in other embodiments, the antenna elements $\mathbf{102}_1$, $\mathbf{102}_2$, $\mathbf{102}_3$, $\mathbf{102}_4$ may have a variable width, e.g. may be tapered. It should be understood that the dimensions of the antenna elements $\mathbf{102}_1$, $\mathbf{102}_2$, $\mathbf{102}_3$, $\mathbf{102}_4$, and accordingly the dimensions of the resulting antenna 100, may vary according to applications. In one example, the antenna 100 may have an overall diameter of 40 mm and a height of 62 mm. In another example, each antenna element $\mathbf{102}_1$, $\mathbf{102}_2$, $\mathbf{102}_3$, or $\mathbf{102}_4$ may be 150 mm long and 10 mm wide. Each antenna element $\mathbf{102}_1$, $\mathbf{102}_2$, $\mathbf{102}_3$, or $\mathbf{102}_4$ may further split into two traces of constant width (e.g. 4 mm wide) or of unequal width. Other dimensions and configurations may apply depending on design requirements.

The antenna elements $\mathbf{102}_1$, $\mathbf{102}_2$, $\mathbf{102}_3$, $\mathbf{102}_4$ may be formed as traces on a flexible printed circuit board (PCB) substrate (not shown) having a thickness in the order of a hundred micrometres (e.g. 0.127 mm). Alternatively, the antenna elements $\mathbf{102}_1$, $\mathbf{102}_2$, $\mathbf{102}_3$, $\mathbf{102}_4$ may be made of wires or strips of an electrically conductive material such as copper, copper-plated steel, conductive polymers, plated plastic of composite material, or the like. For example, the antenna elements $\mathbf{102}_1$, $\mathbf{102}_2$, $\mathbf{102}_3$, $\mathbf{102}_4$ may be made of DuPont™ flexible copper plated substrate. Other suitable materials may be used.

The antenna elements $\mathbf{102}_1$, $\mathbf{102}_2$, $\mathbf{102}_3$, $\mathbf{102}_4$ are physically spaced from one another by an angular distance θ of $2\pi/N$ (or 360/N degrees) in order to increase the isolation between the ports $\mathbf{106}_1$, $\mathbf{106}_2$, $\mathbf{106}_3$, $\mathbf{106}_4$. For instance, in the case of FIG. 1 where N=4, the second antenna element $\mathbf{102}_2$ is wound such that the end $\mathbf{104}_2$ thereof is spaced by an angular distance of 90 degrees from the end $\mathbf{104}_1$ of the first antenna element $\mathbf{102}_1$ (and accordingly the port $\mathbf{106}_2$ is spaced by 90 degrees from the port $\mathbf{106}_1$). Similarly, the third antenna element $\mathbf{102}_3$ is wound such that the end $\mathbf{104}_3$ thereof is spaced by 90 degrees from the end $\mathbf{104}_2$ of the second antenna element $\mathbf{102}_2$ and by 180 degrees from the end $\mathbf{104}_1$ of the first antenna element $\mathbf{102}_1$ (and accordingly the port $\mathbf{106}_3$ is spaced by 90 degrees from the port $\mathbf{106}_2$ and by 180 degrees from the port $\mathbf{106}_1$). Finally, the fourth antenna element $\mathbf{102}_4$ is wound such that the end $\mathbf{104}_4$ thereof is spaced by 90 degrees from the end $\mathbf{104}_3$ of the third antenna element $\mathbf{102}_3$, by 180 degrees from the end $\mathbf{104}_2$ of the second antenna element $\mathbf{102}_2$, and by 270 degrees from the end $\mathbf{104}_1$ of the first antenna element $\mathbf{102}_1$ (and accordingly the port $\mathbf{106}_4$ is spaced by 90 degrees from the port $\mathbf{106}_3$, by 180 degrees from the port $\mathbf{106}_2$, and by 270 degrees from the port $\mathbf{106}_1$).

Figure 2:
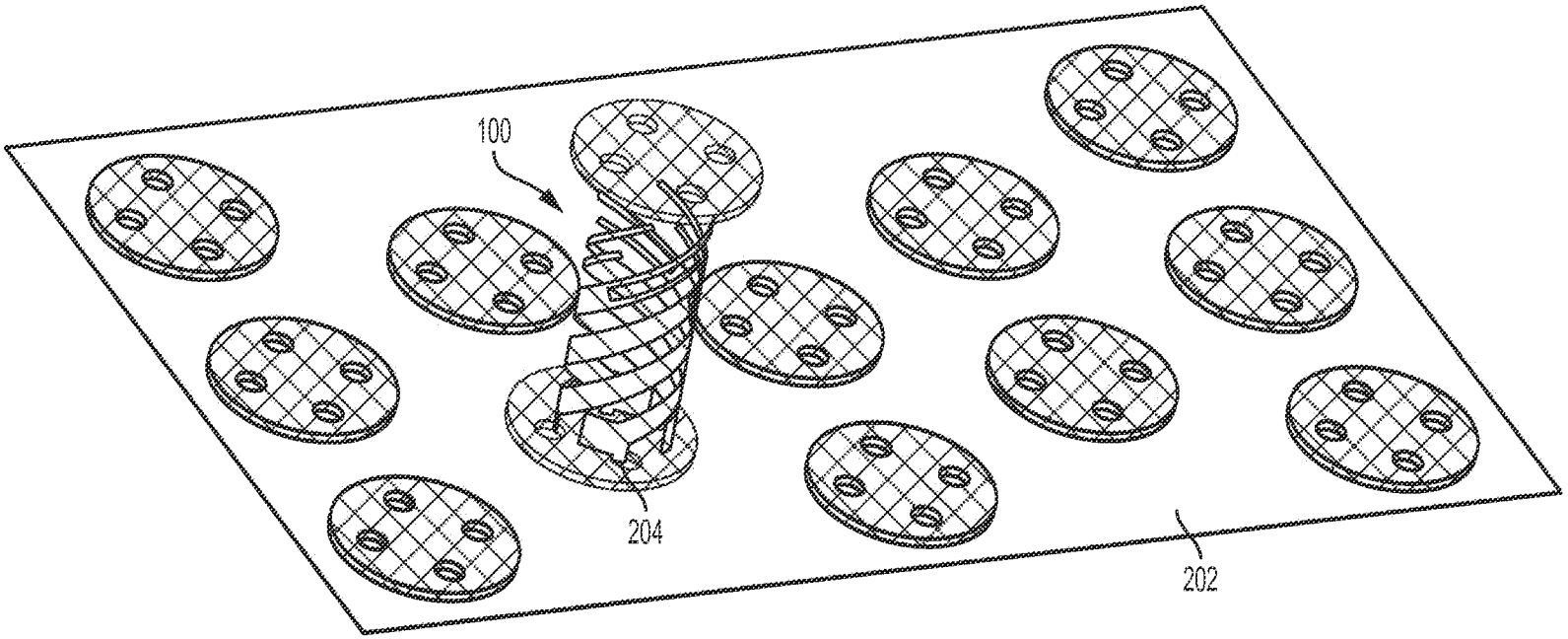
FIG. 2 is a schematic diagram illustrating the use of the helical antenna of FIG. 1 in a massive Multiple-Input-Multiple-Output (MIMO) array, in accordance with one embodiment.

Each antenna 100 may function as a transmitting antenna or as a receiving antenna, and may be used individually or as part of a Multiple-Input-Multiple-Output (MIMO) antenna array. In the embodiment where the antenna 100 is used in a MIMO array (shown in FIG. 2), the antenna 100 is received on a ground plane 202, with each end (references $\mathbf{104}_1$, $\mathbf{104}_2$, $\mathbf{104}_3$, $\mathbf{104}_4$ in FIG. 1) of the antenna elements $\mathbf{102}_1$, $\mathbf{102}_2$, $\mathbf{102}_3$, $\mathbf{102}_4$ being connected to a corresponding port (not shown) provided in an aperture 204 formed in the ground plane 202. The ground plane 202 is a conducting surface that serves as a reflecting surface for radio waves. The ground plane 202 is used to guide (via the ports 206) current from a feed network (not shown) through the antenna elements $\mathbf{102}_1$, $\mathbf{102}_2$, $\mathbf{102}_3$, $\mathbf{102}_4$ for radiating by each antenna 100. The ground plane 202 may behave as a conductive reflector.

Figure 3:
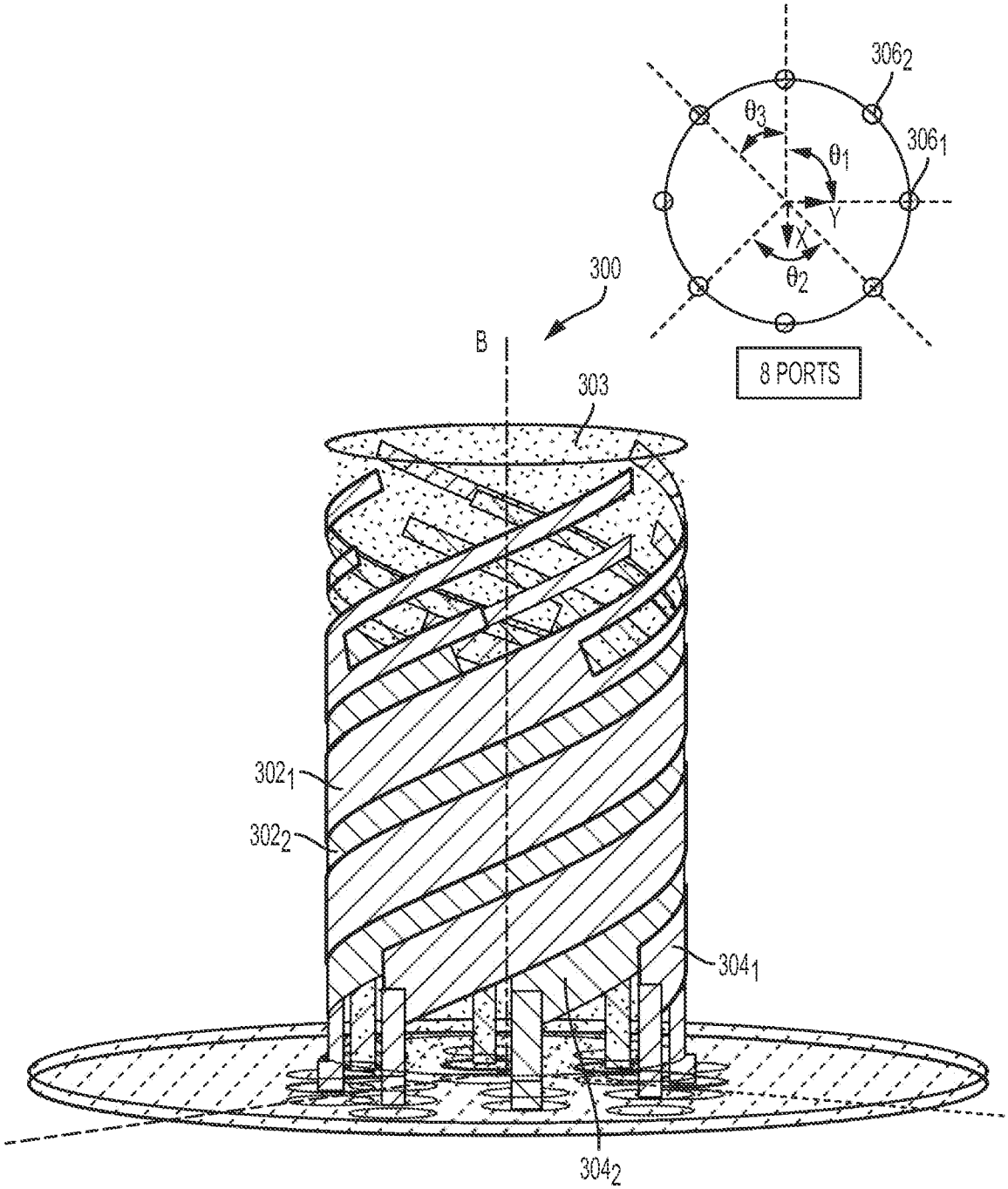
FIG. 3 PRIOR ART
FIG. 3 is a schematic diagram of an eight-port multi-filar helical antenna.

FIG. 3 illustrates a possible winding configuration that may be used as an alternative to the winding configuration of FIG. 1. The antenna 300 of FIG. 3 comprises a first plurality of identical elongate helical antenna elements as in $\mathbf{302}_1$ and a second plurality of identical elongate helical antenna elements as in $\mathbf{302}_2$. The antenna elements $\mathbf{302}_1$ and $\mathbf{302}_2$ may have a constant width throughout the length thereof (as shown) or a variable width. In addition, the width (as well as the length and shape) of the first antenna elements $\mathbf{302}_1$ may be different from that of the second antenna elements $\mathbf{302}_2$. It should also be understood that the antenna element width, length, and/or shape may vary within a same set of antenna elements $\mathbf{302}_1$ or $\mathbf{302}_2$. The antenna elements $\mathbf{302}_1$ and $\mathbf{302}_2$ are alternately wrapped, at a same pitch, around a support surface 303 having a longitudinal axis B. The first and second antenna elements $\mathbf{302}_1$, $\mathbf{302}_2$ may be wound in a left-handed direction or a right-handed direction. In some embodiments, the first antenna elements $\mathbf{302}_1$ are wound in the same direction as the second antenna elements $\mathbf{302}_2$. In other embodiments, the first antenna elements $\mathbf{302}_1$ and the second antenna elements $\mathbf{302}_2$ are wound in different directions to increase the isolation between adjacent antenna ports. For example, left-handed wrapped antenna elements may be wound on the inside of the support surface 303, while right-handed wrapped antenna elements may be wound on the outside of the support surface 303.

Similarly to the antenna 100 of FIG. 1, the antenna elements $\mathbf{302}_1$ are physically spaced from one another by a first angular distance $\theta_1$ of $360°/N_1$ (where $N_1$ is the number of antenna elements $\mathbf{302}_1$) while the antenna elements $\mathbf{302}_2$ are physically spaced from one another by a second angular distance $\theta_2$ of $360°/N_2$ (where $N_2$ is the number of antenna elements $\mathbf{302}_2$). In one embodiment (shown in FIG. 3), $N_1$ is equal to $N_2$ and all antenna elements $\mathbf{302}_1$, $\mathbf{302}_2$ are spaced by the same angular distance. It should however be understood that $N_1$ may differ from $N_2$. For example, the antenna 100 may comprise three (3) antenna elements $\mathbf{302}_1$ and four (4) antenna elements $\mathbf{302}_2$. In addition, each first antenna element $\mathbf{302}_1$ is spaced from an adjacent second antenna element $\mathbf{302}_2$ by a third angular distance $\theta_3$, with $\theta_3>0°$. In one embodiment, $\theta_3=360°/N_1=360°/N_2$. In this manner, consecutive antenna elements $\mathbf{302}_1$, $\mathbf{302}_2$ are spaced from one another by a same angular distance. For instance, in the example of FIG. 3 where $N_1=N_2=4$, the first antenna elements $\mathbf{302}_1$ are wound about the axis B such that adjacent ends $\mathbf{304}_1$ (and accordingly adjacent ports $\mathbf{306}_1$) of the first antenna elements $\mathbf{302}_1$ are spaced by $\theta_1=90$ degrees. Similarly, the second antenna elements $\mathbf{302}_2$ are wound about the axis B such that adjacent ends $\mathbf{304}_2$ (and accordingly adjacent ports $\mathbf{306}_2$) of the second antenna elements $\mathbf{302}_2$ are spaced by $\theta_2=90$ degrees. Each first end $\mathbf{304}_1$ is further spaced from an adjacent second end $\mathbf{304}_2$ (and accordingly each first port $\mathbf{306}_1$ is spaced from an adjacent second port $\mathbf{306}_2$) by $\theta_3=45$ degrees. It should be understood that other embodiments may apply. For instance, $\theta_3$ may be unequal to $360°/N_1$ or $360°/N_2$.

Figure 4:
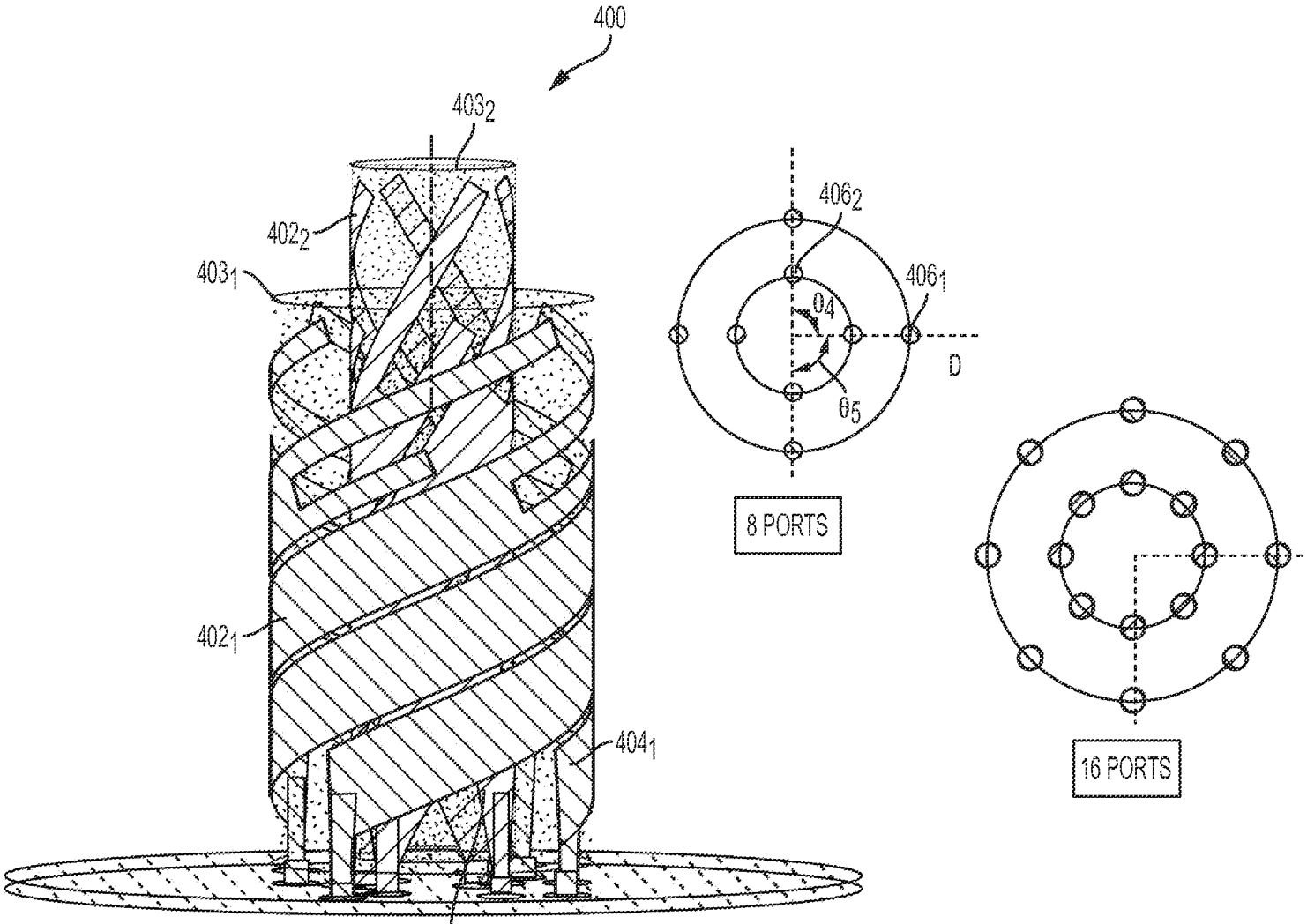
FIG. 4 PRIOR ART
FIG. 4 is another schematic diagram of an eight-port multi-filar helical antenna, illustrating how a sixteen-port multi-filar helical antenna can be achieved.

FIG. 4 illustrates another possible winding configuration that may be used as an alternative to the winding configuration of FIG. 1. The antenna 400 of FIG. 4 comprises a first plurality of identical elongate helical antenna elements as in $\mathbf{402}_1$ and a second plurality of identical elongate helical antenna elements as in $\mathbf{402}_2$. The first antenna elements $\mathbf{402}_1$ are wrapped around a first support surface $\mathbf{403}_1$ having a longitudinal axis C at a first pitch, while the second antenna elements $\mathbf{402}_2$ are wrapped around a second support surface $\mathbf{403}_2$ at a second pitch. In one embodiment, the first support surface $\mathbf{403}_1$ is coaxial with the second support surface $\mathbf{403}_2$, with the first support surface $\mathbf{403}_1$ having a first radius of curvature (or radial distance from the axis C) and the second support surface $\mathbf{403}_2$ having a second radius of curvature smaller than the first radius of curvature. As a result, the first antenna elements $\mathbf{402}_1$ form an outer helix of the antenna 400 and the second antenna elements $\mathbf{402}_2$ form an inner helix, the outer helix coaxial with the inner helix about axis C. It should be understood that, although the antenna elements $\mathbf{402}_1$, $\mathbf{402}_2$ have been illustrated in FIG. 4 as wound around two (2) support surfaces $\mathbf{403}_1$, $\mathbf{403}_2$, more than two (2) coaxially mounted support surfaces may be used.

In one embodiment, in order to ensure that both the inner helix of antenna elements $\mathbf{402}_2$ and the outer helix of antenna elements $\mathbf{402}_1$ are operable simultaneously at the same frequency, the inner helix is provided with a height that is greater than the height of the outer helix. It should be understood that the inner and outer helices may be operated at different frequencies. The antenna elements $\mathbf{402}_1$, $\mathbf{402}_2$ may have a constant width throughout the length thereof (as shown) or a variable width. In addition, the width (as well as the length and shape) of the first antenna elements $\mathbf{402}_1$ may be different from that of the second antenna elements $\mathbf{402}_2$. The first and second antenna elements $\mathbf{402}_1$, $\mathbf{402}_2$ may be wound in a left-handed direction or a right-handed direction. In some embodiments, the first antenna elements $\mathbf{402}_1$ are wound in the same direction as the second antenna elements $\mathbf{402}_2$. In other embodiments, the first antenna elements $\mathbf{402}_1$ and the second antenna elements $\mathbf{402}_2$ are wound in different directions to increase the isolation between adjacent antenna ports. The radii of the inner and outer support surfaces can also be selected so as to improve the isolation between antenna ports.

The first and second antenna elements $\mathbf{402}_1$ are physically spaced from one another by an angular distance $\theta_4$ of $2\pi/N_3$ (or $360/N_3$ degrees, where $N_3$ is the number of antenna elements $\mathbf{402}_1$) while the second antenna elements $\mathbf{402}_2$ are physically spaced from one another by a second angular distance $\theta_5$ of $2\pi/N_4$ (or $360/N_4$ degrees, where $N_4$ is the number of antenna elements $\mathbf{402}_2$). In one embodiment (shown in FIG. 4), $N_3$ is equal to $N_4$ such that the antenna elements $\mathbf{402}_1$, $\mathbf{402}_2$ are spaced by the same angular distance. Each end $\mathbf{404}_1$ of the first antenna elements $\mathbf{402}_1$ is further aligned with a corresponding end $\mathbf{404}_2$ of the second antenna elements $\mathbf{402}_2$ (and accordingly each port $\mathbf{406}_1$ is aligned with a port $\mathbf{406}_2$) along a direction D transverse to the axis C. In other embodiments, each first antenna element $\mathbf{402}_1$ may be offset from an adjacent second antenna element $\mathbf{402}_2$, i.e. adjacent antenna elements $\mathbf{402}_1$, $\mathbf{402}_2$ may be separated by an angular distance $\theta_6$, with $\theta_6>0°$, equal or unequal to $360/N_3$ or $360/N_4$. The number of ports of each antenna 300 or 400 may be varied by varying the number of the first antenna elements $\mathbf{302}_1$, $\mathbf{402}_1$ and/or the number of the second antenna elements $\mathbf{302}_2$, $\mathbf{402}_2$. In the embodiments of FIG. 3 and FIG. 4, eight-port antennas 300, 400 are achieved. Sixteen-port antennas can also be achieved by adding more antenna elements $\mathbf{302}_1$, $\mathbf{402}_1$, $\mathbf{302}_2$, $\mathbf{402}_2$.

Figure 5D:
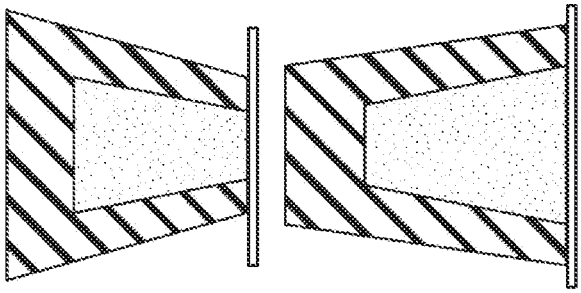
FIGS. 5A, 5B, 5C, and 5D illustrate schematic diagrams of possible wrapping configurations for the antenna elements of FIG. 3 and FIG. 4, in accordance with one embodiment.
Figure 5C:
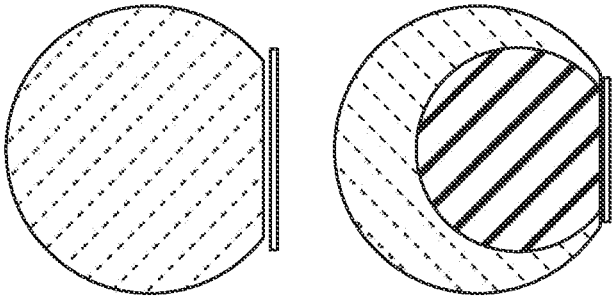
Figure 5B:
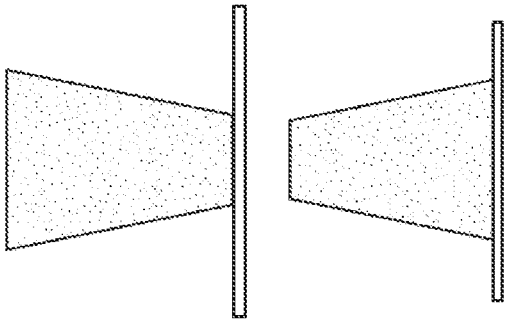
Figure 5A:
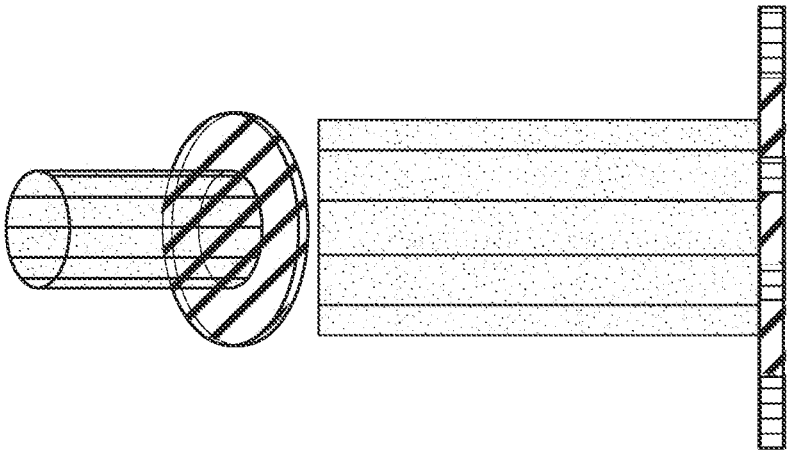

As discussed above, the antenna elements (references $\mathbf{102}_1$, $\mathbf{102}_2$, $\mathbf{102}_3$, $\mathbf{102}_4$, $\mathbf{302}_1$, $\mathbf{302}_2$, and $\mathbf{402}_1$, $\mathbf{402}_2$ in FIG. 1, FIG. 3, and FIG. 4) of each helical antenna (references 100, 300 and 400 in FIG. 1, FIG. 3, and FIG. 4) are wound around one or more support surfaces each having a given radius of curvature, which may be constant or variable along the length of the surface. In some embodiments, both the inner and the outer helix of antenna elements have either a constant radius or a variable radius. In other embodiments, one of the inner and the outer helix of antenna elements may have a constant radius while the other one of the inner and the outer helix of antenna elements has a variable radius. Examples of support surfaces having a constant radius include, but are not limited to, a cylindrical surface (as shown in FIG. 1, FIG. 3, and FIG. 4) and a multi-sided polyhedron (as shown in FIG. 5A, which illustrates a twelve-sided polyhedron). Examples of support surfaces having a variable radius include, but are not limited to, a conical surface (as shown in FIG. 5B, which illustrates a single conical surface, and FIG. 5D, which illustrates collocated inner and outer conical surfaces) and a spherical surface (as shown in FIG. 5C, which illustrates at the top of the figure a single spherical surface and at the bottom of the figure collocated spherical surfaces). Frusto-conical and hemispherical surfaces may also apply. It should be understood that the shape formed by the winding configuration of the antenna elements may depend on the desired pattern shape, isolation between antenna ports, and bandwidth to be achieved. For example, winding the antenna elements around a spherical surface may allow for radiation pattern control and wider bandwidth compared to winding the antenna elements around a cylindrical or conical surface. Embodiments other than those shown in FIGS. 5A, 5B, 5C, and 5D may therefore apply, and any surface generated by rotating a curve or an angled segment around the antenna's longitudinal axis may be used as a support surface.

Figure 6:
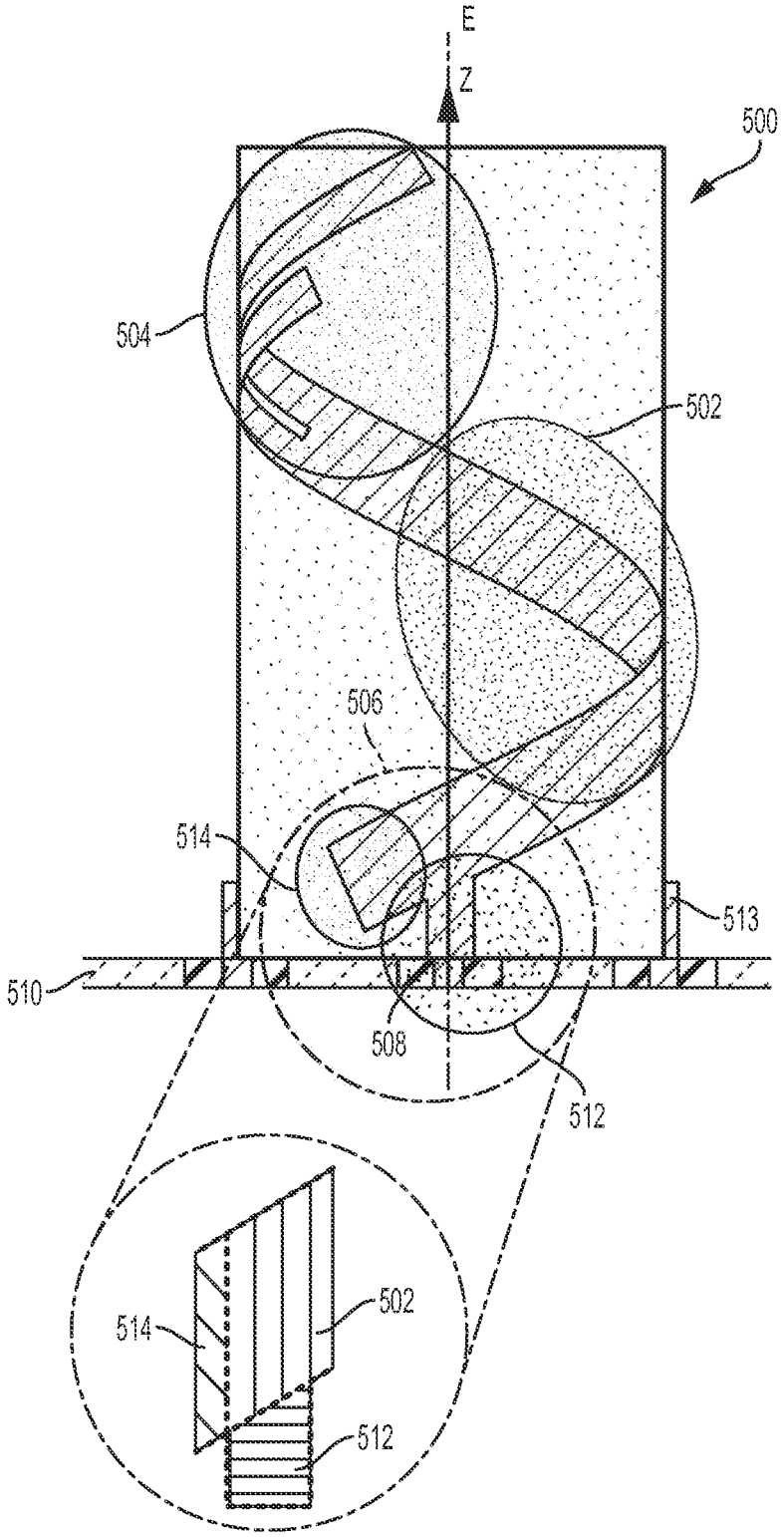
FIG. 6 is a schematic diagram of an antenna element of an N-port multi-filar helical antenna, in accordance with one embodiment.

FIG. 6 illustrates the configuration of a single helical antenna element 500, in accordance with one embodiment. The antenna element 500 comprises an elongate body 502 having a first (or crown) end section 504 and a second end section 506 opposite the first end section 504. The first end section 504 is a free open-circuited end while, in some embodiments, the second end section 506 is configured to be received in an aperture 508 formed in a ground plane 510, thereby securing the antenna element 500 to the ground plane 510. In other embodiments, a positioning member (or positioner) 512 is provided at the second end section 506, the positioner 512 configured to be received in the aperture 508 for securing the antenna element 500 to the ground plane 510. The antenna element 500 can then be connected to a feed network (not shown) through a port (e.g. a coaxial port, not shown) that is provided at the aperture 508. The port may be connected to the antenna element 500 via a connector pin or probe 513 attached (e.g. soldered, or the like) to the positioning member 512 or to the end section 506 (when no positioning member 512 is provided). As will be discussed further below, in some embodiments, the second end section 506 may also comprise a tail member 514 that extends away from the body 502.

Referring now to FIG. 7A, FIG. 7B, FIG. 7C, and FIG. 7D in addition to FIG. 6, various geometries can be used for the second end section (reference 506 in FIG. 6) of each antenna element as in 500. As discussed above, in some embodiments, the second end section 506 comprises a first (or positioning) member 512, also referred to herein as a positioner, that extends away from the antenna element's body 502, along a direction substantially parallel to the longitudinal axis E of the support surface 602. The first member 512 is configured to extend towards the ground plane 510 for securing the antenna element 500 to the ground plane 510. As discussed above, this may be achieved by inserting the first member 512 into an aperture 508 formed in the ground plane 510. The second end section 506 may further comprise a second (or tail) member (as in 514 in FIG. 7A) that is connected to the first member 512 and extends away from the body 502 so as to be positioned at a given distance (not shown) above the ground plane 510. It should be understood that, depending on the applications, the antenna element as in 500 may be provided with at least one of the first (or positioning) member 512 and the second (or tail) member 514, with both members 512, 514 forming an integral part of the antenna body 502 (as can be seen in FIG. 6). The members 512, 514 may thus be printed on a flexible PCB substrate and form a single piece with the body 502. In some embodiments, the tail member 514 may be integrated with the positioning member 512 (e.g. so as to form a cohesive member) and the geometry of both members 512, 514 optimized for wideband.

The first (or positioning) member 512 extends away from the body 502 of the antenna element 500 along a direction substantially parallel to the longitudinal axis E of the support surface or structure 602. In this manner, the helix of antenna elements as in 500 can be positioned at a desired angle (e.g. so as to extend along a direction substantially perpendicular to the ground plane) and at a desired distance relative to the ground plane. In particular, the antenna element 500 can be raised above the ground plane 510 and positioned at a given distance therefrom, the given distance depending on the dimensions (e.g. the height) and profile of the positioning member 512. This in turn allows to feed the antenna element 500 at the given distance above the ground plane and to tune each separately fed antenna element 500 directly at the feed point region. In addition, the height and width of the positioning member 512 can be adjusted to tune the antenna's resonance bandwidth such that the positioning member 512 serves as a tuning section that is inherently built in (i.e. forms an integral part of) the antenna element 500. Use of the positioner 512 thus alleviates the need for providing an additional tuning horizontal board, thereby achieving a compact antenna design. In the embodiments illustrated herein, the positioning member 512 is shows as having a trapezoidal shape (see, for instance, the horizontally hatched shape of FIG. 6). It should however be understood that other configurations may apply.

The second (or tail) member 514 may have a curved profile that follows the curvature of the support surface 602. The geometry (e.g. width, height, length) of the second member 514 may be selected depending on the application. In particular, the second member 514 serves as a frequency band broadening section, which is inherently built in (i.e. forms an integral part of) the antenna element 500. In the embodiment shown in FIG. 7A, the second member 514 extends along a direction 604, which follows the helical path 606 of the antenna element 500, and is at an angle φ to the longitudinal axis E. In the embodiment shown in FIG. 7B, the antenna 500 comprises a second member 514' that extends away from the antenna element's body 502 along a direction 604' that is angled relative to the helical path 606 of the antenna element 500. In particular, the second member 514' is positioned so that the direction 604' is at an angle φ of substantially 90 degrees to the axis E.

Figure 7A:
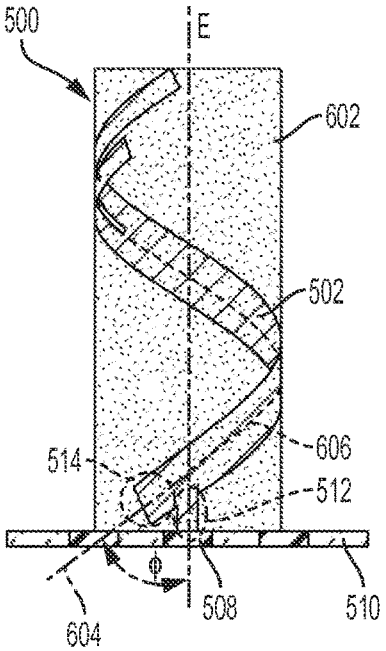
FIGS. 7A, 7B, 7C, and 7D illustrate schematic diagrams of possible configurations for the tail member of the antenna element of FIG. 6, in accordance with another embodiment.
Figure 7B:
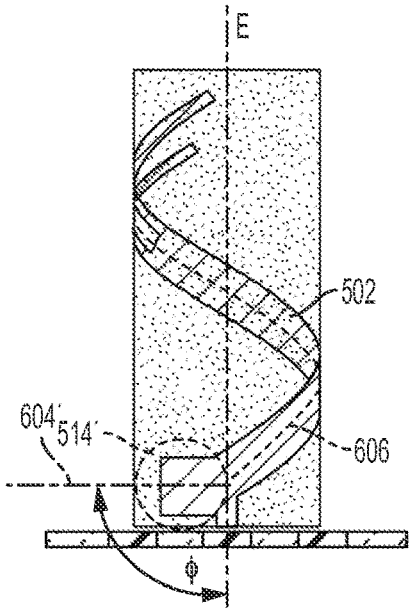
Figure 7C:
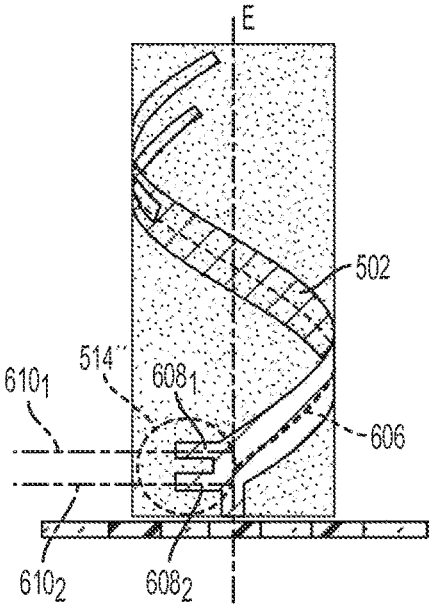
Figure 7D:
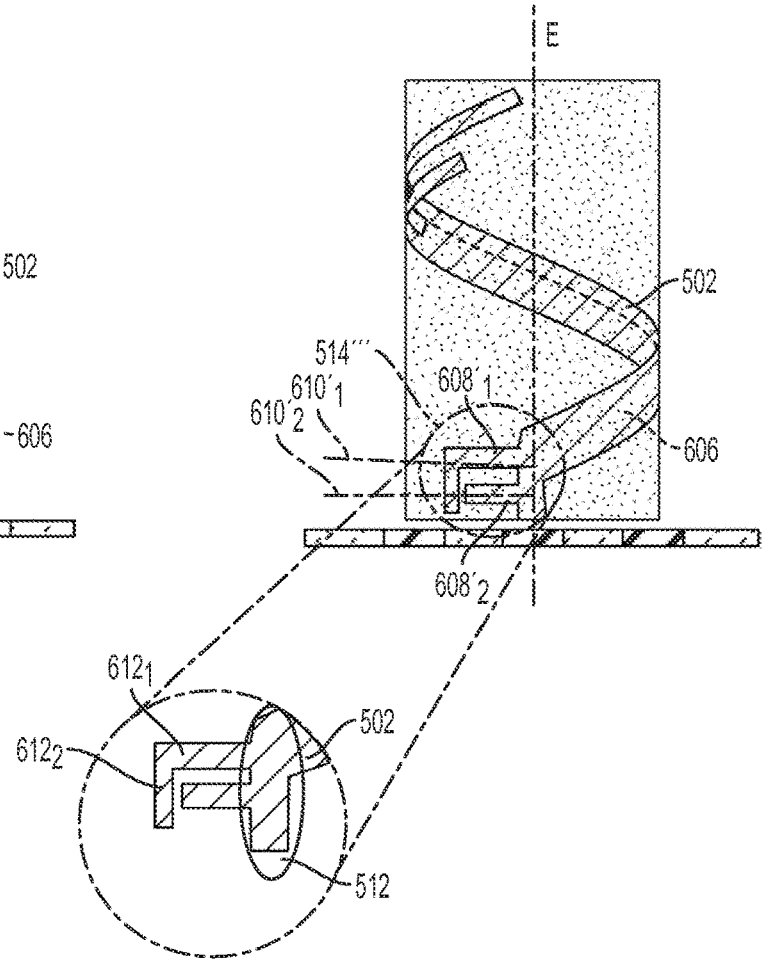

Although the second (or tail) members 514, 514' are shown in FIG. 7A and FIG. 7B as comprising a single element (or arm), it should be understood that other configurations may apply. For example, the second members 514 or 514' may comprise two (2) or more arms. FIG. 7C shows a second member 514" according to one embodiment, the second member 514" comprising a first elongate arm $\mathbf{608}_1$ extending along a first direction $\mathbf{610}_1$ substantially perpendicular to the axis E and a second arm $\mathbf{608}_2$ extending along a second direction $\mathbf{610}_2$ substantially parallel to the first direction $\mathbf{610}_1$. FIG. 7D shows a second member 514'" according to another embodiment, the second member 514'" comprising a first angled arm $\mathbf{608'}_1$ and a second elongate arm $\mathbf{608'}_2$. The first arm $\mathbf{608'}_1$ comprises a first section $\mathbf{612}_1$ and a second section $\mathbf{612}_2$ angled relative to the first section $\mathbf{612}_1$. In the illustrated example, the first section $\mathbf{612}_1$ extends along a direction $\mathbf{610'}_1$ substantially perpendicular to the axis E and the second section $\mathbf{612}_2$ extends along a direction (not shown) substantially parallel to the axis E, such that the angle (not shown) between the first and second sections $\mathbf{612}_1$, $\mathbf{612}_2$ is substantially equal to 90 degrees. The second arm $\mathbf{608'}_2$ extends along a direction $\mathbf{610'}_2$ substantially perpendicular to the axis E. It should be understood that other embodiments may apply. For example, the angle between the first and second sections $\mathbf{612}_1$, $\mathbf{612}_2$ of the first arm $\mathbf{608'}_1$ may have a value (e.g. 45 degrees) other than 90 degrees. In one embodiment, the angle between the first and second sections $\mathbf{612}_1$, $\mathbf{612}_2$ of the first arm $\mathbf{608'}_1$ is between 0 degrees and 90 degrees. The first arm $\mathbf{608'}_1$ may also comprise more than two (2) sections as in $\mathbf{612}_1$, $\mathbf{612}_2$. In addition, although the first arm $\mathbf{608'}_1$ is illustrated as having sharp edges, curved edges may also apply. In some embodiments, the second arm $\mathbf{608'}_2$ may also be angled.

It should be understood that a variety of possible configurations can be achieved for the second (or tail member) as in 514 by varying at least one parameter of the tail member as in 514, including, but not limited to varying the tail member's angle relative to the antenna element's helical path, the tail member's size, the tail member's length, the tail member's width, the tail member's distance from the ground plane 510, the tail member's curvature, the tail member's number of arms, the spacing between the arms, the thickness of each arm, the width of each arm, the height of each arm, and the angle of each arm. Different tail member geometries can then be implemented to locate resonances and broaden antenna bandwidth. Indeed, modifying the geometry (particularly the size and shape) of the tail member as in 514 changes the antenna's impedance profile for broadening the antenna's resonance bandwidth. In addition, the positioning of the tail member as in 514 relative to the positioning member as in 512 affects the frequency response (or resonance) of the antenna element 500. Therefore, the overall antenna performance can be affected by selection of the tail member parameters. In particular, the embodiments illustrated in FIG. 7C and FIG. 7D achieve a wider bandwidth than the embodiments of FIG. 7A and FIG. 7B, with the widest antenna bandwidth being achieved using the configuration shown in FIG. 7D. For example, FIG. 12 (discussed further below) shows the return loss as a function of frequency for the embodiment of FIG. 7A and FIG. 14 (discussed further below) shows that a 27% wide band frequency response can be achieved with the embodiment of FIG. 7D.

Figure 8A:
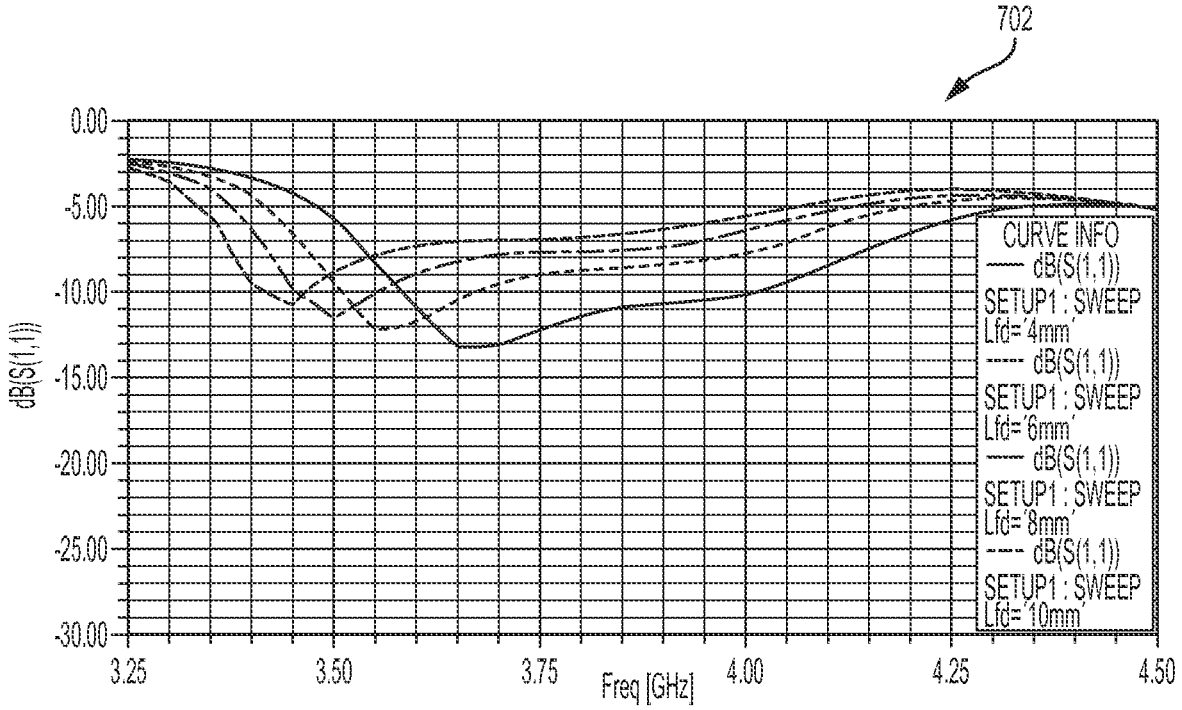
FIG. 8A shows a plot of S-parameter $S_{11}$ as a function of frequency for an antenna (shown in FIG. 8B) comprising antenna elements having a positioning member but no tail member, in accordance with one embodiment.
Figure 8B:
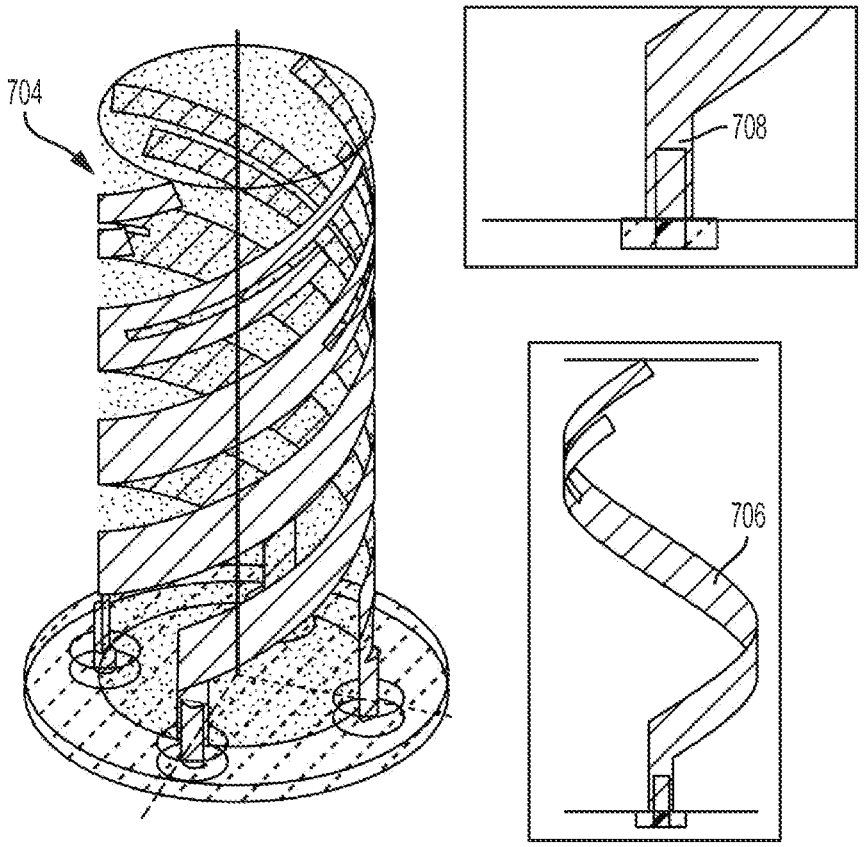

FIG. 8A illustrates a plot 702 of S-parameter $S_{11}$ as a function of frequency for an antenna 704 of FIG. 8B comprising antenna elements as in 706 provided with a positioning member 708 only (i.e. no tail member). Plot 702 shows results when the length of the positioning member 708 varies from 4 mm to 10 mm. When the positioning member 708 has a length of 10 mm, a resonant frequency of 3.45 GHz (at about −10 dB) is achieved. When the positioning member 708 has a length of 8 mm, a resonant frequency of 3.50 GHz (at about −11 dB) is achieved. When the positioning member 708 has a length of 6 mm, a resonant frequency of 3.55 GHz (at about −12 dB) is achieved. When the positioning member 708 has a length of 4 mm, a resonant frequency of 3.65 GHz (at about −13 dB) is achieved. FIG. 8 thus shows that providing the positioning member 708 allows to improve the tuning of the antenna's impedance matching, as discussed above. Improved tuning can indeed be achieved by positioning the helix of antenna elements at a given distance away from the ground plane (rather than positioning the helix of antenna elements in direct contact with the ground plane), the given distance depending on the length of the positioning member, as discussed above. Raising the antenna elements above the ground plane in turn adjusts the location of the antenna's resonant frequency (as seen in plot 702), thereby providing improved impedance matching.

Figure 9A:
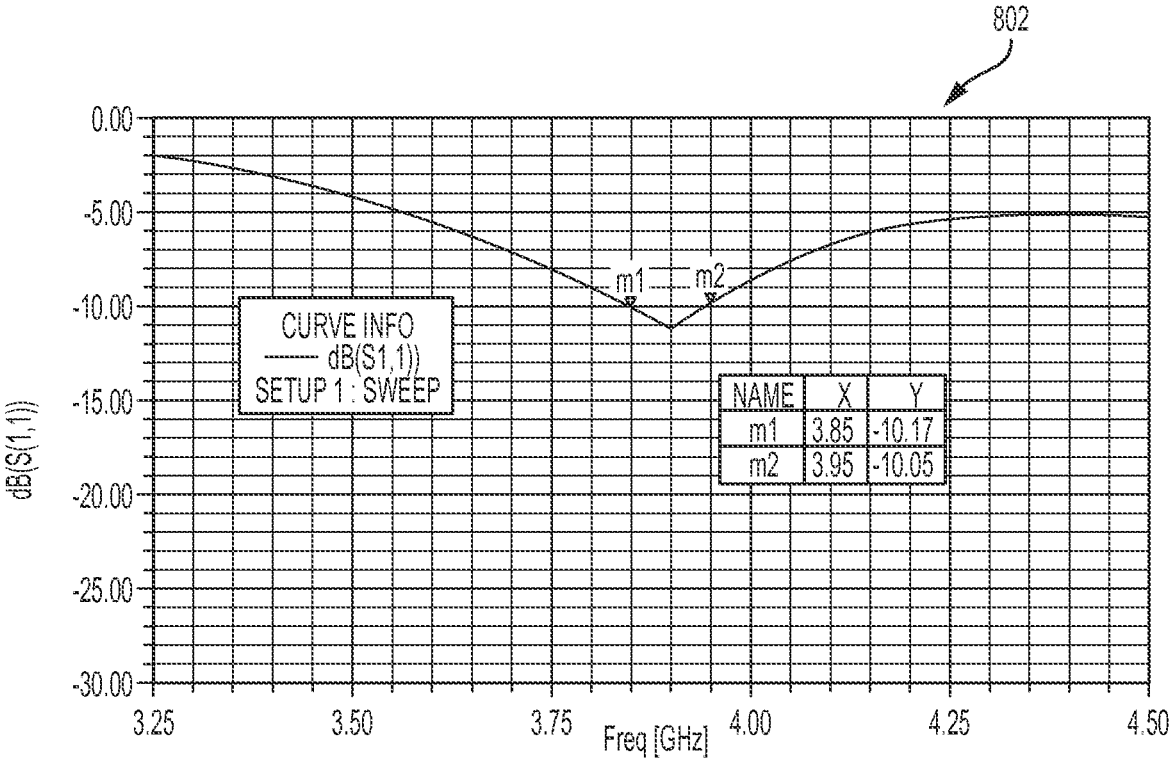
FIG. 9A shows a plot of S-parameter $S_{11}$ as a function of frequency for an antenna (shown in FIG. 9B) comprising antenna elements having a tail member but no positioning member, in accordance with one embodiment.
Figure 9B:
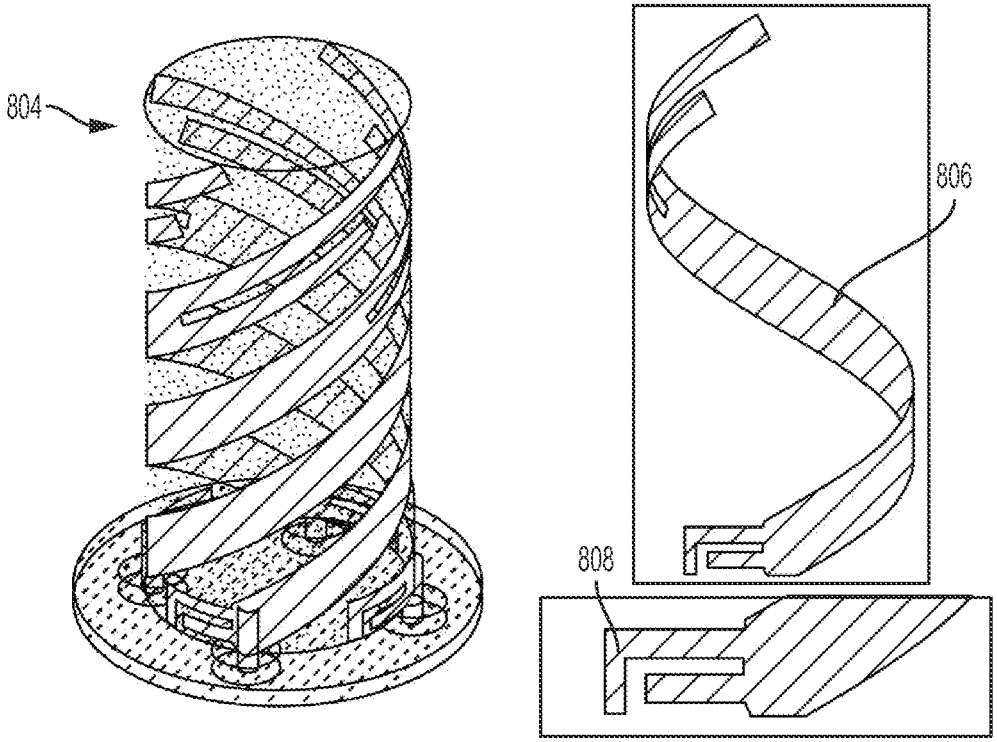

Referring now to FIG. 9A, which illustrates a plot 802 of S-parameter $S_{11}$ as a function of frequency for an antenna 804 of FIG. 9B comprising antenna elements as in 806 provided with a tail member 808 only (i.e. no positioning member), it can be seen that provision of the tail member 808 allows to achieve wide antenna bandwidth. Indeed, a resonant frequency located at 3.9 GHz (at −11 dB) and a 100 MHz 10 dB return loss bandwidth can be achieved for the embodiment of FIG. 9B.

Figure 10:
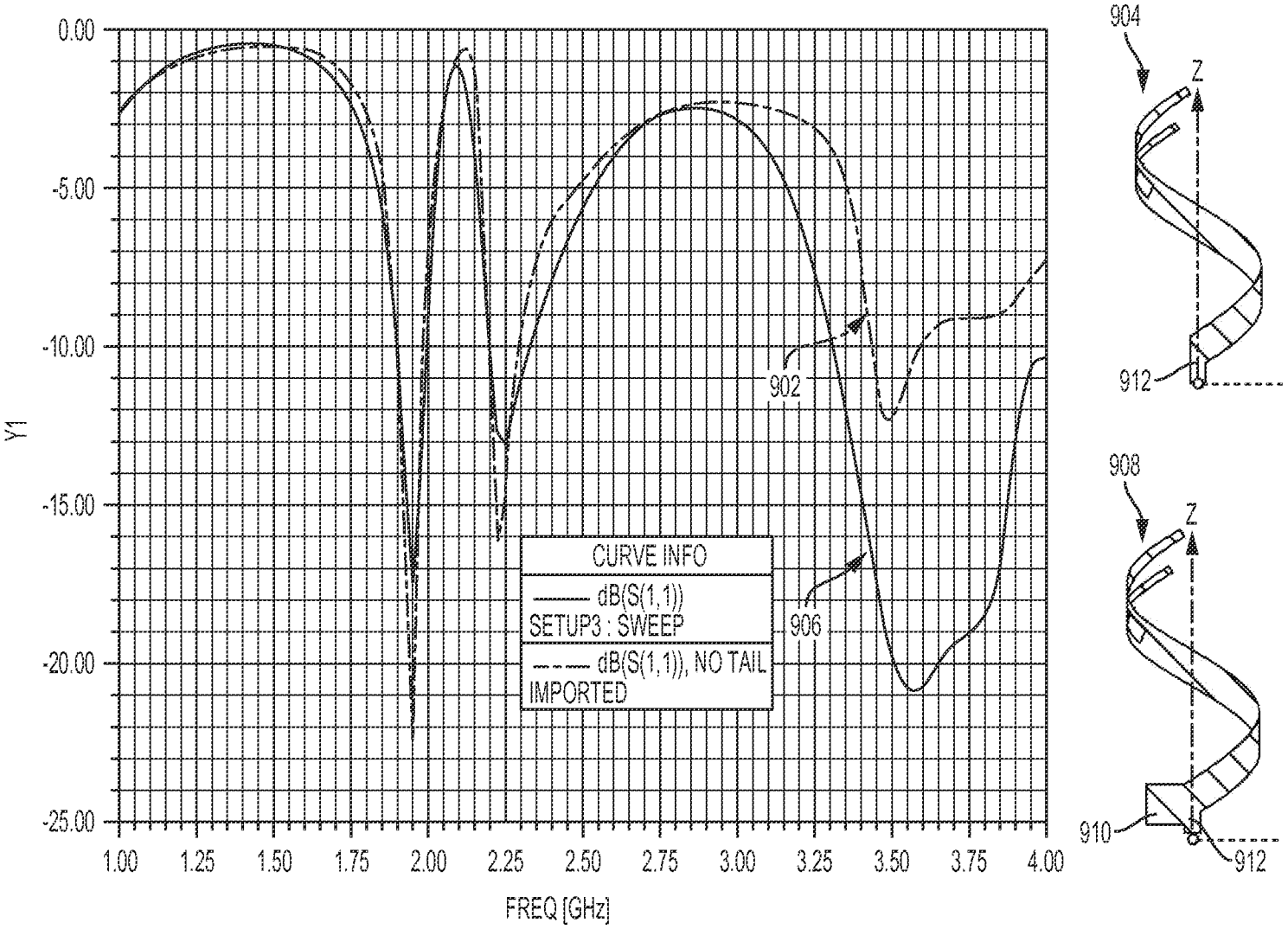
FIG. 10 shows a first plot of S-parameter $S_{11}$ as a function of frequency for an antenna element having a tail member and a positioning member, and a second plot of S-parameters as a function of frequency for an antenna element having a positioning member and no tail member, in accordance with one embodiment.
Figure 11:
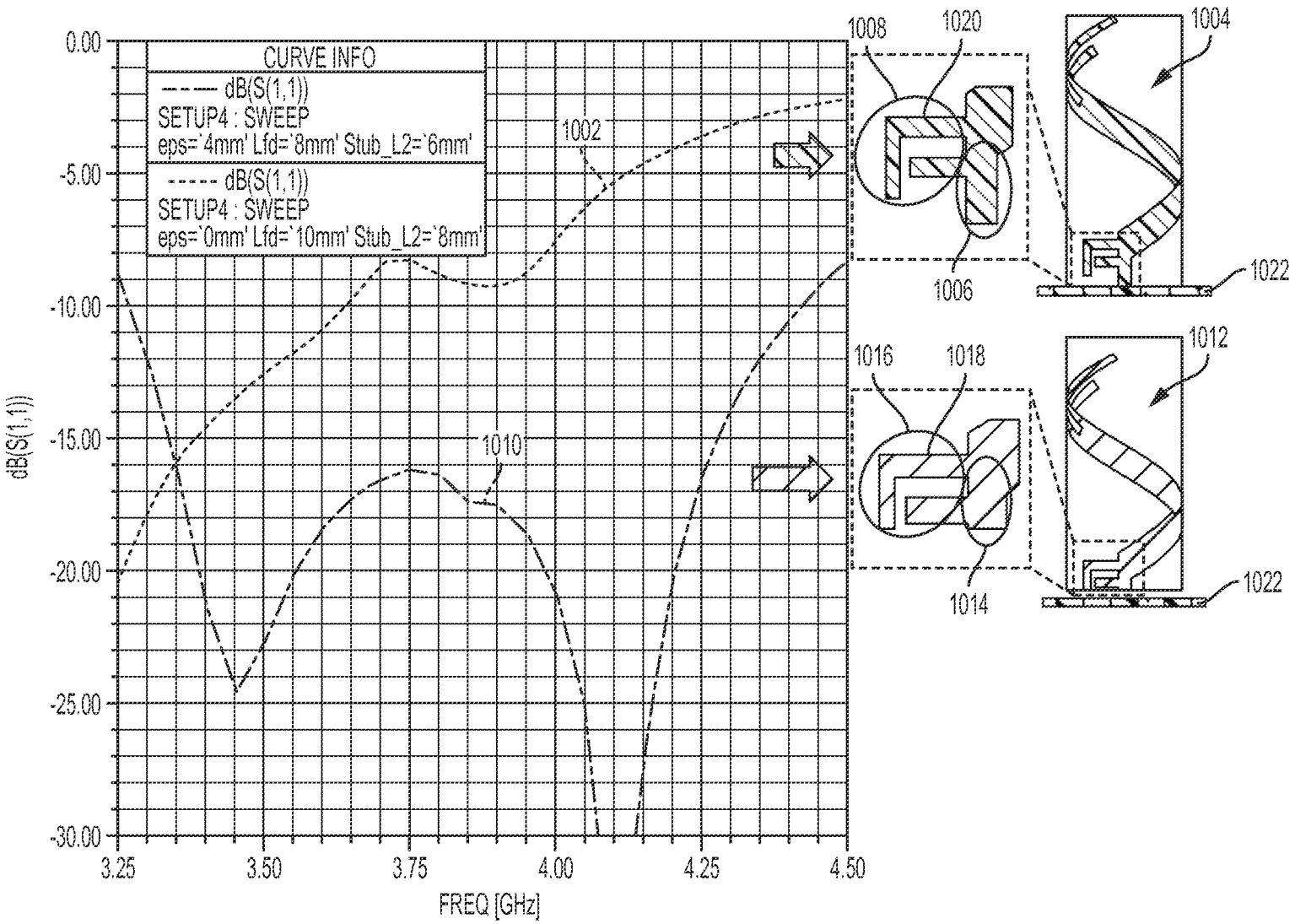
FIG. 11 shows plots of S-parameter $S_{11}$ as a function of frequency for two different antenna elements each having a tail member and a positioning member, in accordance with one embodiment.

From FIG. 10 and FIG. 11, it can also be seen that providing the individual antenna elements with both a tail member and a positioning member, broadens the antenna's bandwidth and allows to achieve well matched impedance. FIG. 10 shows a plot 902 of S-parameter $S_{11}$ as a function of frequency for an antenna where individual antenna elements as in 904 are not provided with such a tail member. FIG. 10 also shows a plot 906 of S-parameter $S_{11}$ as a function of frequency for an antenna where individual antenna elements as in 908 are provided with a tail member 910 having the configuration shown in FIG. 7B. It can be seen that the bandwidth (see plot 902), which can be achieved for an antenna where the antenna elements 904 do not comprise a tail member (but comprise a positioning member 912), is narrower than the bandwidth (see $S_{11}$ plot 906) that can be achieved for an antenna where the antenna elements 908 are provided with a tail member 910 (in addition to the positioning member 912).

From FIG. 11, it can also be seen that, by providing the individual antenna elements with both a tail member and a positioning member and selectively adjusting the geometries of the tail member and/or the positioning member, it is possible to achieve well matched impedance, in addition to broadening the antenna's bandwidth. Overall antenna performance can therefore be improved. In particular, FIG. 11 illustrates a plot 1002 of S-parameter $S_{11}$ as a function of frequency for an antenna where individual antenna elements as in 1004 are provided with both a positioner as in 1006 and a tail member 1008 having a configuration similar to that shown in FIG. 7D. FIG. 11 also illustrates a plot 1010 of S-parameter $S_{11}$ as a function of frequency for an antenna where individual antenna elements as in 1012 are provided with both a positioner as in 1014 and a tail member 1016. Similarly to the tail member 1008, the tail member 1016 has the configuration shown in FIG. 7D. However, the arm 1018 of tail member 1016 has different dimensions (e.g. a vertical length shorter by about 2 mm) than the arm 1020 of tail member 1008.

In addition, the positioner 1014 has different dimensions (e.g. a shorter height) than the positioner 1006. As a result, using the illustrated geometry for the positioner 1014, the antenna element 1012 (and accordingly the tail member 1014) can be brought closer to the ground plane 1022 than the antenna element 1004 (and accordingly the tail member 1006). This in turn allows broadening of the antenna's bandwidth in addition to improving impedance matching, as can be seen in plots 1002 and 1010. Plot 1002 indeed shows that a mismatched impedance is obtained for an antenna comprising antenna elements as in 1004 while plot 1010 shows that the impedance is well matched for an antenna comprising antenna elements as in 1012. Plot 1002 further shows that a resonant frequency of 3.25 GHz (at −20 dB) is achieved for an antenna comprising antenna elements as in 1004 while two resonances, respectively located at 3.45 GHz (at −24.5 dB) and about 4.2 GHz (at −30 dB), can be achieved with an antenna comprising antenna elements as in 1012, thereby broadening the bandwidth.

Figure 12:
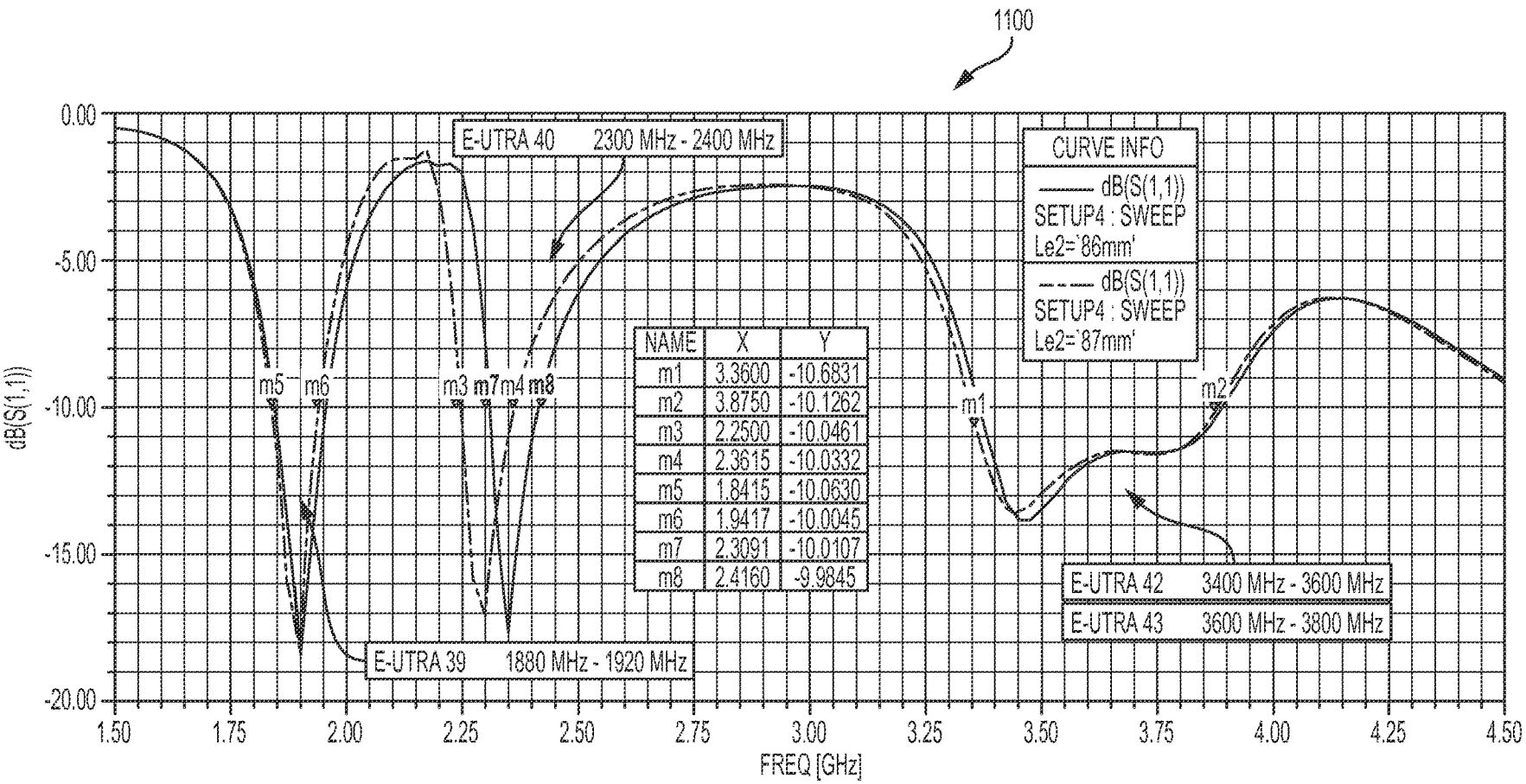
FIG. 12 shows a plot of return loss as a function of frequency that illustrates two separate narrow bands (E-UTRA 39 and E-UTRA 40) and a wideband (combined E-UTRA 42 and E-UTRA 43) that can be achieved for an antenna having a tail member and a positioning member, in accordance with one embodiment.

Moreover, it can be seen from FIG. 12 that the proposed antenna configuration can be used for a variety of applications. FIG. 12 illustrates a return loss plot 1100 for a multi-filar antenna comprising antenna elements having a tail member with a geometry as shown in FIG. 7A, in addition to a positioning member. It can be seen that the return loss comprises several bands of operation, namely two separate narrow bands (evolved Universal Mobile Telecommunications System (UMTS) Terrestrial Radio Access (E-UTRA) 39 and E-UTRA 40) and a wideband (combined E-UTRA 42 and E-UTRA 43. The proposed antenna can therefore be used for double band applications (E-UTRA 39, 1880 MHz-1920 MHz frequency range), lower frequency applications (E-UTRA 40, 2300 MHz-2400 MHz frequency range), or in the European frequency band (E-UTRA 42, 3400 MHz-3600 MHz frequency range, or E-UTRA 43, 3600 MHz-3800 MHz frequency range). It should be understood that, depending on the configuration of the antenna element's tail member, other applications may apply.

Figure 13:
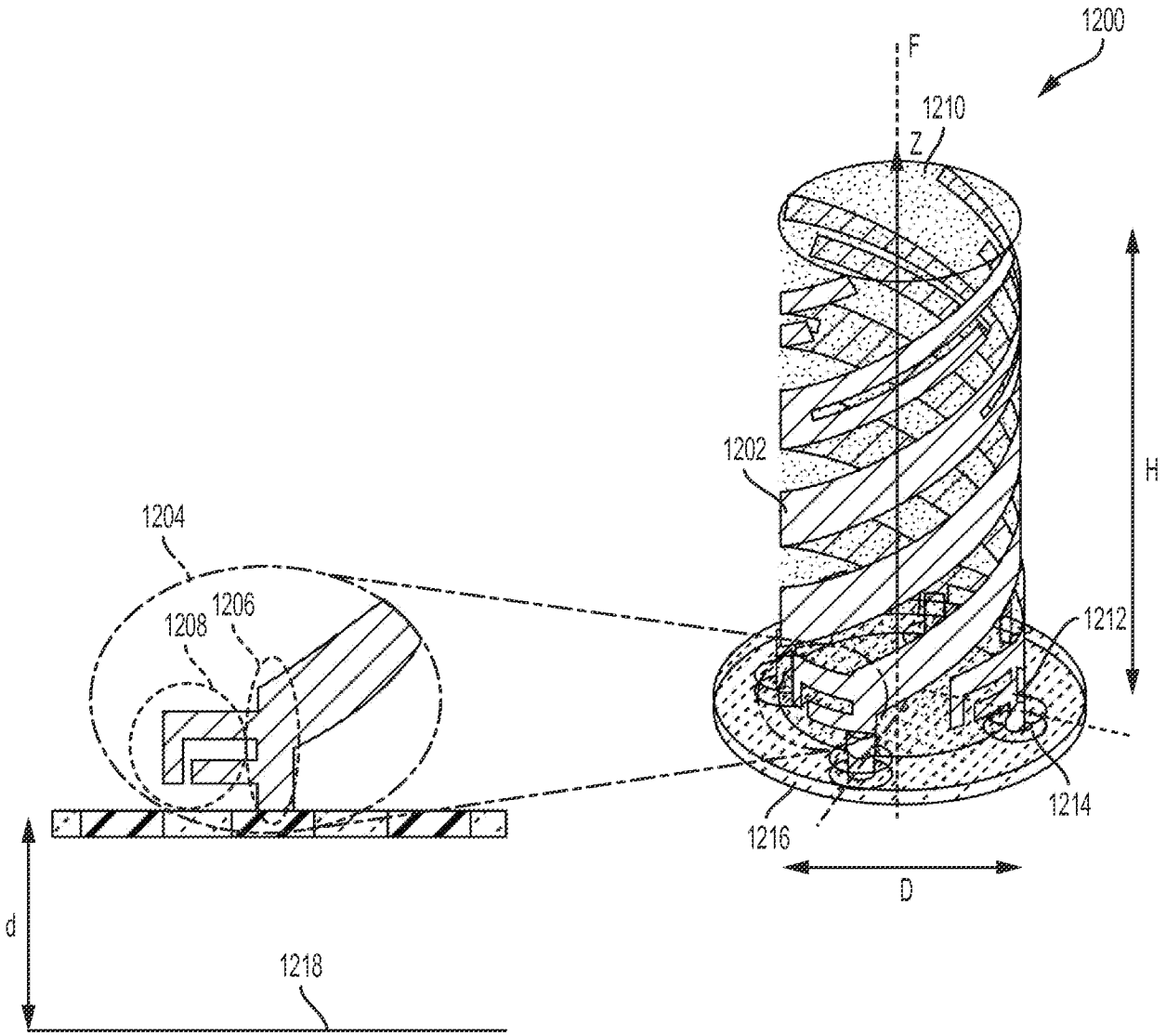
FIG. 13 is a schematic diagram of a helical antenna spaced from a ground plane, in accordance with one embodiment.

Referring now to FIG. 13, FIG. 14, FIG. 15, and FIG. 16, it can be seen that the spacing between the helix of antenna elements and the ground plane can also affect the overall antenna performance. FIG. 13 shows an illustrative antenna 1200, which comprises four (4) antenna elements 1202 each provided at the second end section 1204 thereof with a positioner 1206. The illustrated end sections 1204 each comprise, in addition to the positioner 1206, a tail member 1208 having a geometry as shown in FIG. 7D. Each positioner 1206 extends away from the second end section 1204 in a direction substantially parallel to the longitudinal axis F of the support structure (or surface) 1210 around which the antenna elements 1202 are wrapped. The positioner 1206 is attached (e.g. soldered, or the like) to a connector pin (or probe) 1212 configured to be received in an aperture 1214 formed in a circular disc 1216 positioned at a given distanced above the ground plane 1218. Each antenna element 1202 can then be fed independently and multi-resonances generated. In the embodiment of FIG. 13, the connector pin 1212 is configured such that the bottom face (not shown) of the support structure 1210 rests upon the circular disc 1216 when the connector pin 1212 is received in the aperture 1214. The value of the distance d between the circular disc 1216 and the ground plane 1218 may vary depending on the application. In one embodiment, the distance d is equal to 25 mm for an antenna 1200 having a height H equal to 62 mm and a diameter D equal to 40 mm. Other embodiments may apply. For example, the distanced may be equal to zero and the circular disc 1216 may rest on the ground plane 1218.

Figure 14:
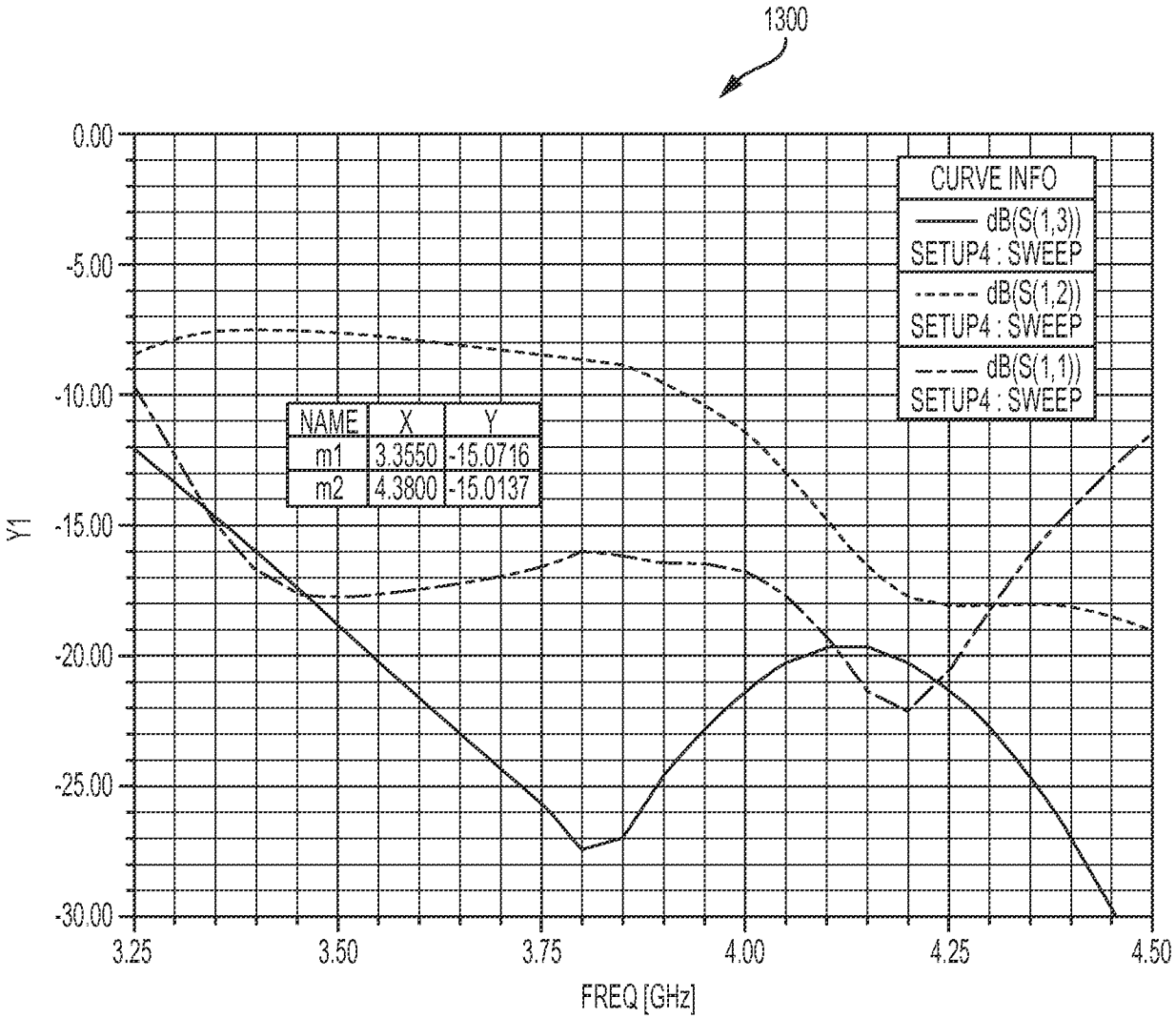
FIG. 14 is a plot of S parameters as a function of frequency for the helical antenna of FIG. 13.

FIG. 14 illustrates a plot 1300 of S-parameters as a function of frequency for the antenna 1200 of FIG. 13. FIG. 14 shows a 27% (at −15 dB) wide band frequency response for the antenna 1200. In particular, it can be seen from FIG. 14 that a bandwidth between 3.355 and 4.38 GHz can be achieved.

Figure 15:
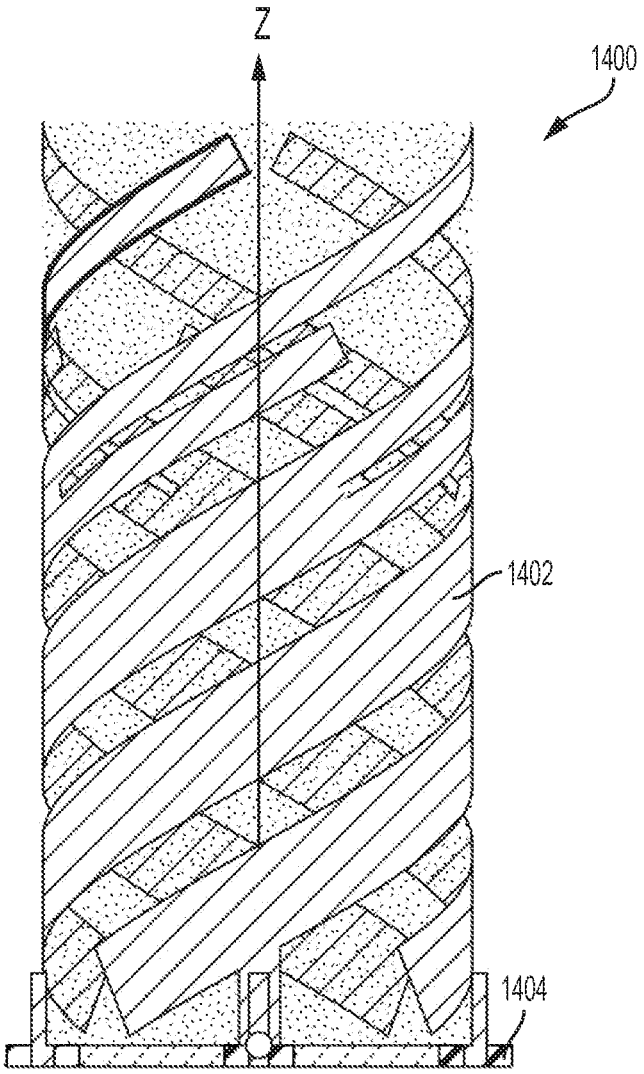
FIG. 15 is a schematic diagram of a helical antenna mounted to a ground plane, in accordance with one embodiment.
Figure 16:
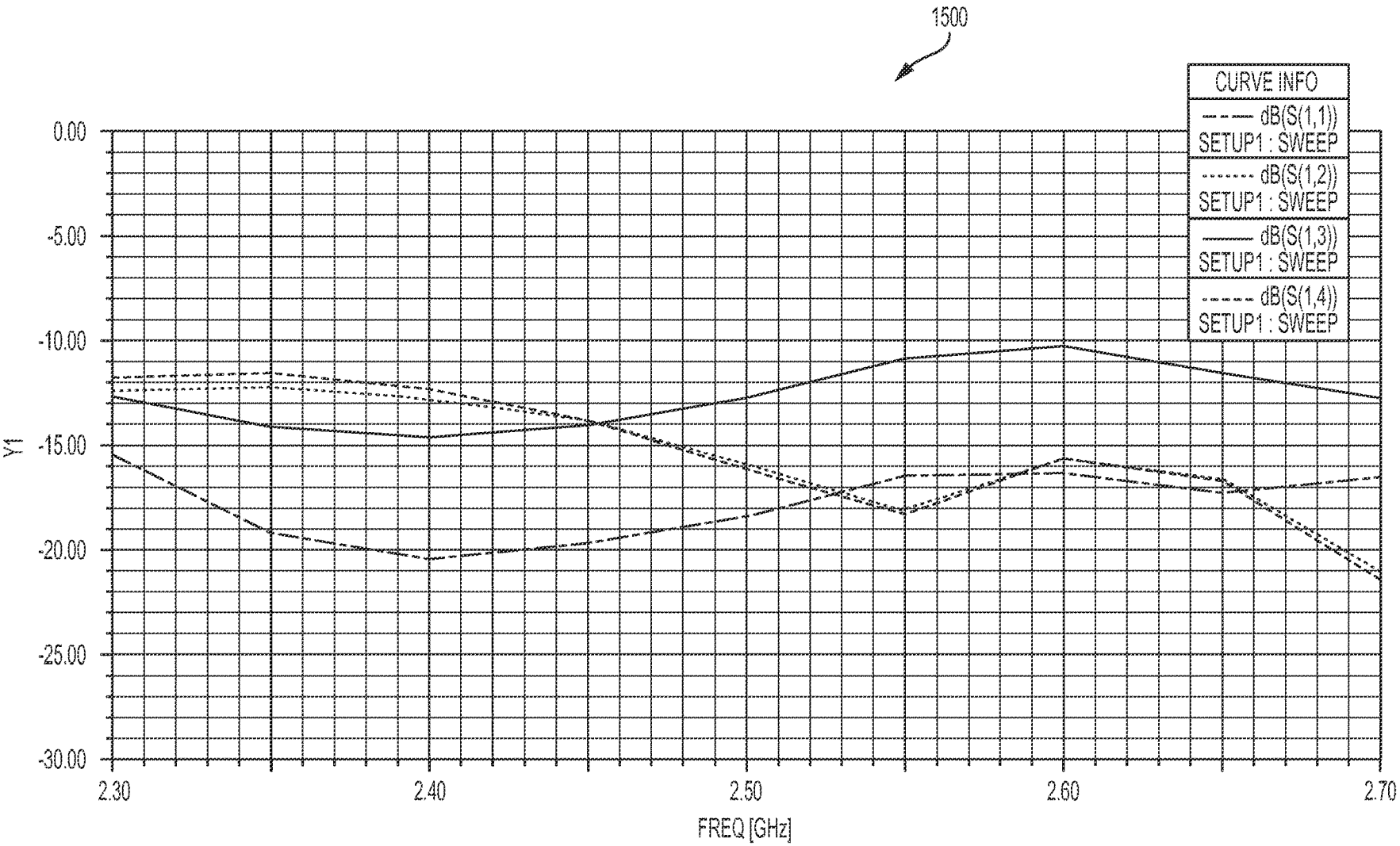
FIG. 16 is a plot of S parameters as a function of frequency for the helical antenna of FIG. 15.

FIG. 15 shows an alternate embodiment of a multi-filar helical antenna 1400 comprising four (4) antenna elements 1402. In this embodiment, the circular disc (reference 1216 in FIG. 13) is not spaced from the ground plane 1404, as is the case for the antenna 1200 of FIG. 13, but is in direct contact with the ground plane 1404 such that the distance d (see FIG. 13) is substantially equal to zero. This in turn affects the antenna's tuning, as can be seen from FIG. 16, which illustrates a plot 1500 of S-parameters as a function of frequency for the antenna 1400 of FIG. 15. It can be seen from FIG. 16 that a bandwidth between 2.3 and 2.7 GHz can be achieved (compared to the bandwidth between 3.4 and 3.8 GHz of FIG. 14) for the embodiment of FIG. 15. FIG. 16 also shows that, in the embodiment of FIG. 15, a return loss below −15 dB and an intra-element coupling (i.e. the interference of a given antenna port to every other port of the antenna) lower than −10 dB are achieved.

Figure 17B:
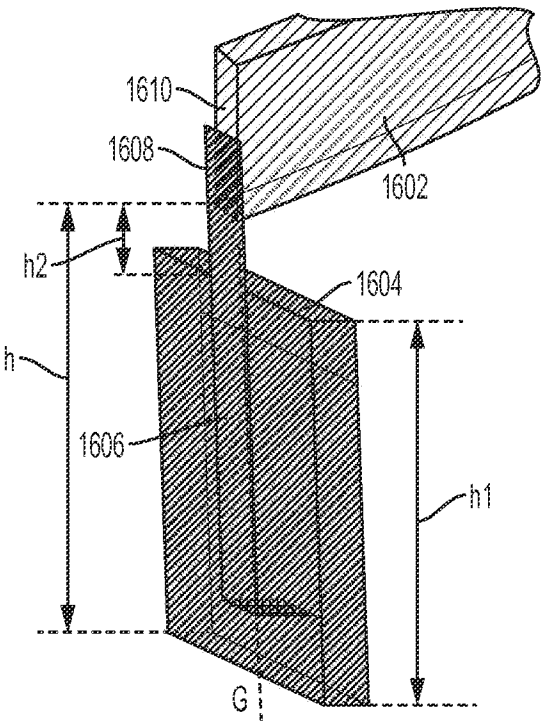
FIG. 17A and FIG. 17B are schematic diagrams of a Printed Circuit Board (PCB) feed for a helical antenna element, in accordance with one embodiment.
Figure 17A:
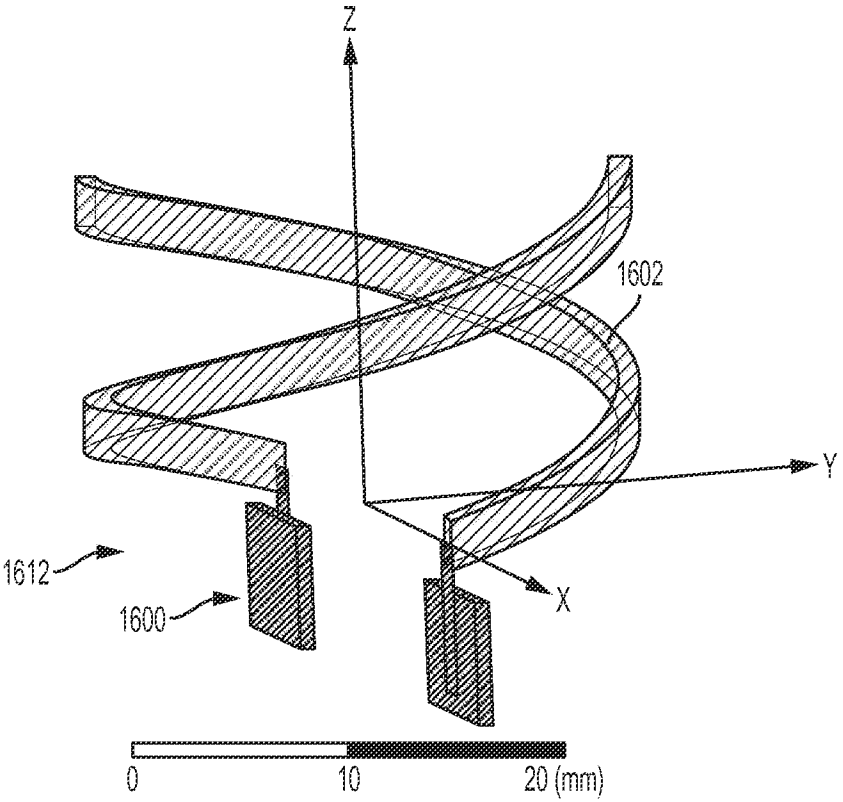

Referring now to FIG. 17A and FIG. 17B, a Printed Circuit Board (PCB) feed 1600 for a multi-filar helical antenna, in accordance with an illustrative embodiment, will now be described. The illustrated feed 1600 is connected to a given antenna element 1602 of the multi-filar antenna. The feed 1600 comprises a first member 1604 that is shaped as a rectangular parallelepiped and is provided on an outer surface thereof with an electrical transmission line, e.g. a microstrip line 1606, that extends along a direction substantially parallel to a longitudinal axis G of the first member 1604. The first member 1604 is made of an electrically conductive material, such as copper, and forms with the microstrip line 1606 a vertical dielectric providing the antenna element 1602 with a vertical transmission line. In one embodiment, a 50 Ohm feed transmission line can be achieved. The microstrip line 1606 protrudes away from the first member 1604 and has a free end 1608 configured to contact an end 1610 of the antenna element 1602. For antenna elements having tail members (not shown) with a positioner (not shown), the microstrip line 1606 may be configured to contact the positioner and merge therewith, thereby forming an extension of the positioner.

In one embodiment, a plurality of identical feeds as in 1600 are provided, with each feed 1600 being connected to a corresponding antenna element as in 1602 of the multi-filar antenna. Using the feed 1600, the helix formed by the antenna elements 1602 can be raised above the ground plane 1612 by a height h (and accordingly fed at the height h) at least equal to the height h1 of the first member 1604. Upon being fed with the feed 1600, the antenna generates circular polarization radiation. In some embodiments, the microstrip line 1606 is configured to protrude away from the first member 1604, such that the antenna element 1602 is spaced from the first member 1604. In this case, the helix of antenna elements 1602 is raised above the ground plane 1612 by a height equal to a sum of the height h1 and the distance h2 between an upper surface (not shown) of the first member 1604 and a lower surface (not shown) of the antenna element 1602. In one embodiment, the feed 1600 is used to raise the antenna elements 1602 about 24 mm above the ground plane 1612. Other embodiments may apply. The feed 1600 may thus be used as an alternative to providing each antenna element 1602 a positioner (reference 512 in FIG. 6).

The above description is meant to be exemplary only, and one skilled in the relevant arts will recognize that changes may be made to the embodiments described without departing from the scope of the invention disclosed. The structure illustrated is thus provided for efficiency of teaching the present embodiment. The present disclosure may be embodied in other specific forms without departing from the subject matter of the claims.

The present disclosure is also intended to cover and embrace all suitable changes in technology. Modifications which fall within the scope of the present invention will be apparent to those skilled in the art, and, in light of a review of this disclosure, such modifications are intended to fall within the appended claims.

What is claimed is:

1. A multi-filar helical antenna comprising:

a plurality of helical radiating elements extending along a longitudinal axis that are formed as traces on a flexible printed circuit board substrate, each of the plurality of helical radiating elements comprising:

an elongate body extending from a first end section of the helical radiating element to a second end section of the helical radiating element, the first end section configured to be open-ended and the second end section configured to be connected to a feed port through an aperture of a conductive surface;

a positioning member integrally formed on the second end section of the helical radiating element and configured to secure the helical radiating element to the aperture of the conductive surface and to connect to the feed port; and a protruding tail member integrally formed at a terminal end of the second end section of the helical radiating element and configured to be open-ended and protrude beyond a location of the positioning member.

2. The antenna of claim 1, wherein the protruding tail member extends along a helical path of the elongate body.

3. The antenna of claim 1, wherein the protruding tail member extends along a direction substantially perpendicular to the longitudinal axis.

4. The antenna of claim 1, wherein the protruding tail member comprises a first arm and at least one second arm spaced from the first arm.

5. The antenna of claim 4, wherein the first arm is substantially parallel to the at least one second arm.

6. The antenna of claim 4, wherein at least one of the first arm and the at least one second arm comprises a first section and a second section, the first section angled relative to the second section.

7. The antenna of claim 4, wherein the first arm comprises a first section and a second section, the first section substantially parallel to the at least one second arm and the second section substantially perpendicular to the at least one second arm.

8. The antenna of claim 1, wherein at least one of a size of the protruding tail member, a length of the protruding tail member, a width of the protruding tail member, a height of the protruding tail member, a curvature of the protruding tail member, an angle of the protruding tail member relative to the longitudinal axis, a second distance between the protruding tail member and the electrically conductive surface, a number of arms of the protruding tail member, a spacing between arms of the protruding tail member, an angle of each arm of the protruding tail member, a thickness of each arm of the protruding tail member, a width of each arm of the protruding tail member, and a height of each arm of the protruding tail member is adjusted for at least one of modifying an impedance of the radiating element and broadening a resonance bandwidth of the antenna.

9. The antenna of claim 1, wherein the radiating element further comprises a positioning member extending away from the second end along a direction substantially parallel to the longitudinal axis, an end portion of the positioning member configured to be secured to the electrically conductive surface in connection with the feeding port, the radiating element fed, via the feeding port, at the given distance above the conductive surface.

10. The antenna of claim 1, further comprising a feed comprising a printed circuit board member configured to be secured to the electrically conductive surface in connection with the feeding port, the printed circuit board member provided on an outer surface thereof with an electrical transmission line extending away from the printed circuit board member along a direction substantially parallel to the longitudinal axis, the transmission line configured to contact the second end at the given distance for feeding the radiating element at the given distance above the conductive surface.

11. The antenna of claim 1, comprising a first plurality of the radiating element.

12. The antenna of claim 11, further comprising a second plurality of the radiating element, each radiating element of the first plurality spaced apart from one another by a first angular distance and each radiating element of the second plurality spaced apart from one another by a second angular distance equal to the first angular distance.

13. The antenna of claim 1, wherein the radiating element is wrapped around the longitudinal axis in one of a right-handed direction and a left-handed direction.

14. The antenna of claim 12, wherein the first plurality of the radiating element is positioned at a first radial distance from the longitudinal axis and the second plurality of the radiating element is positioned at a second radial distance from the longitudinal axis, the second radial distance smaller than the first radial distance.

15. The antenna of claim 12, wherein the first plurality of the radiating element is positioned at a first radial distance from the longitudinal axis and the second plurality of the radiating element is positioned at a second radial distance from the longitudinal axis, the second radial distance equal to the first radial distance and the first and second plurality of the radiating element alternately wrapped around the longitudinal axis.

16. The antenna of claim 1, wherein the radiating element conforms to a shape selected from the group consisting of a polyhedron, a cylindrical shape, a spherical shape, and a conical shape.

17. The antenna of claim 1, wherein the radiating element is printed on a flexible printed circuit board substrate.

* * * * *